US010147267B2

(12) United States Patent
Yee et al.

(10) Patent No.: US 10,147,267 B2
(45) Date of Patent: Dec. 4, 2018

(54) METHODS OF ADMINISTERING ROULETTE BONUS WAGERS AND RELATED APPARATUSES AND SYSTEMS

(71) Applicant: Bally Gaming, Inc., Las Vegas, NV (US)

(72) Inventors: Ryan Masao Yee, Las Vegas, NV (US); Roger M. Snow, Las Vegas, NV (US); John Hemberger, Las Vegas, NV (US); Zbigniew Czyzewski, Henderson, NV (US); Elliot Frome, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/463,567

(22) Filed: Mar. 20, 2017

(65) Prior Publication Data

US 2017/0193747 A1 Jul. 6, 2017

Related U.S. Application Data

(63) Continuation of application No. 14/033,097, filed on Sep. 20, 2013, now Pat. No. 9,600,974.

(51) Int. Cl.
*G07F 17/32* (2006.01)

(52) U.S. Cl.
CPC ..... *G07F 17/3244* (2013.01); *G07F 17/326* (2013.01); *G07F 17/3286* (2013.01)

(58) Field of Classification Search
CPC .. A63F 2003/00309; A63F 2003/00312; A63F 2003/00315; A63F 5/00;
(Continued)

(56) References Cited

U.S. PATENT DOCUMENTS 5,042,810 A 8/1991 Williams et al.
5,588,650 A 12/1996 Eman et al.
(Continued)

OTHER PUBLICATIONS

PCT International Search Report and Written Opinion of the International Searching Authority for PCT/US14/56621, dated Dec. 31, 2014, 14 pages.
(Continued)

*Primary Examiner* — David L Lewis
*Assistant Examiner* — Matthew D. Hoel
(74) *Attorney, Agent, or Firm* — TraskBritt

(57) ABSTRACT

Methods of administering games of roulette may involve accepting a wager may from a player. A multiplier may be randomly selected from a group of fixed multipliers for a payout on the wager. A number and associated color may be randomly generated from within a range of numbers and associated colors. The wager may be resolved by determining whether the randomly generated number is identical to a randomly generated number from an immediately preceding round. A payout may be paid to the player when the randomly generated number is identical to the randomly generated number from the immediately preceding round, an amount of the payout being equal to an amount of the wager multiplied by the randomly selected multiplier. The amount of the wager may be collected for the house when the randomly generated number is different from the randomly generated number from the immediately preceding round.

20 Claims, 10 Drawing Sheets

(58) Field of Classification Search
CPC ..... G07F 17/3244; G07F 17/3262; G07F 17/326; G07F 17/3286
See application file for complete search history.

(56) References Cited

U.S. PATENT DOCUMENTS

| | | | |
|---|---|---|---|
| 5,707,285 | A | 1/1998 | Place et al. |
| 5,718,431 | A | 2/1998 | Ornstein et al. |
| 5,743,798 | A | 4/1998 | Adams et al. |
| 5,743,800 | A | 4/1998 | Huard et al. |
| 5,788,574 | A | 8/1998 | Ornstein et al. |
| 5,851,010 | A | 12/1998 | Feinberg et al. |
| 5,934,999 | A | 8/1999 | Valdez et al. |
| 6,059,659 | A | 5/2000 | Busch et al. |
| RE37,588 | E | 3/2002 | Ornstein |
| 6,481,717 | B1 | 11/2002 | Richardelle |
| 6,659,866 | B2 | 12/2003 | Frost et al. |
| 6,679,492 | B2 | 1/2004 | Markowiak |
| 6,755,741 | B1 | 6/2004 | Rafaeli |
| 7,094,150 | B2 | 8/2006 | Ungaro et al. |
| 7,661,676 | B2 | 2/2010 | Smith et al. |
| 7,669,853 | B2 | 3/2010 | Jones |
| 7,892,083 | B2 | 2/2011 | Okada |
| D663,785 | S | 7/2012 | Walsh et al. |
| 8,272,958 | B2 | 9/2012 | Smith et al. |
| 2002/0142823 | A1* | 10/2002 | DeMar ..... G07F 17/3267 463/16 |
| 2003/0071417 | A1 | 4/2003 | Webb |
| 2004/0023712 | A1 | 2/2004 | Oliver |
| 2005/0020347 | A1 | 1/2005 | Moshal |
| 2005/0164759 | A1 | 7/2005 | Smith et al. |
| 2005/0192076 | A1 | 9/2005 | Lowery |
| 2009/0093290 | A1 | 4/2009 | Lutnick et al. |
| 2009/0239605 | A1 | 9/2009 | Ekisheva et al. |
| 2011/0223983 | A1* | 9/2011 | Schwartz ..... G07F 17/3211 463/17 |
| 2013/0053117 | A1 | 2/2013 | Snow |
| 2013/0184059 | A1 | 7/2013 | Costello et al. |
| 2013/0184079 | A1 | 7/2013 | Costello et al. |
| 2014/0087829 | A1 | 3/2014 | Watkins et al. |
| 2014/0094244 | A1 | 4/2014 | Baron et al. |

OTHER PUBLICATIONS

Singapore Examination Report for Singapore Application No. 11201601670U dated May 18, 2016, 13 pages.
Australian Examination Report from Australian Application No. 2014321349, dated May 31, 2018, 3 pages.

* cited by examiner

METHODS OF ADMINISTERING ROULETTE BONUS WAGERS AND RELATED APPARATUSES AND SYSTEMS

CROSS-REFERENCE TO RELATED APPLICATION

This application is a continuation of U.S. patent application Ser. No. 14/033,097, filed Sep. 20, 2013, now U.S. Pat. No. 9,600,974, issued Mar. 21, 2017 the disclosure of which is hereby incorporated herein in its entirety by this reference.

FIELD

This disclosure relates generally to methods of administering wagering games for casinos and other gaming establishments, and related systems and apparatuses. More specifically, disclosed embodiments relate to methods of administering roulette games in which a wager may be accepted, and a payout on the wager may be paid when the same, consecutive winning outcome is repeated in two successive rounds of play, an amount of the payout being an amount of the wager multiplied by a randomly selected multiplier.

BACKGROUND

Roulette is a popular wagering game played in casinos and other gaming establishments. Avid players are generally open to, and sometimes specifically seek out, new and more interesting ways to play roulette, particularly when the reward for a winning outcome at the end of a round of play, or the odds of achieving a winning outcome, may be enhanced. For example, U.S. Pat. No. 5,743,798, issued Apr. 28, 1998, to Adams et al., discloses a progressive side bet for roulette that a player wins when the player bets on the same winning number four times in a row, an amount of the winnings being a fixed amount that grows with successive rounds; a progressive pot, less a rake; or a randomly selected amount. Similarly, U.S. Pat. No. 5,042,810, issued Aug. 27, 1991, to Williams, discloses a progressive side bet for roulette that a player wins when the same winning number occurs three and four games in a row, an amount of the winnings being an amount accumulated in a progressive pot. U.S. Pat. No. 5,743,800, issued Apr. 28, 1998, to Huard et al., discloses a progressive side bet applicable to roulette that a player wins when a randomly selected number is the winning number or when the player is simply randomly selected from a number of players or player positions, which may further involve randomly selecting the amount of the prize as a fixed amount or as a percentage of a progressive pot. U.S. Pat. No. 5,718,431, issued Feb. 17, 1998, to Ornstein, discloses a streak side wager for roulette that a player wins when the player achieves a preselected number of consecutive wins on the same conventional roulette wager (e.g., odds, evens, red, black, split, box, specific number, etc.). U.S. Patent App. Pub. No. 2005/0020347, published Jan. 27, 2005, to Moshal, discloses a progressive side wager for roulette that a player wins when the outcome of a round and the outcome of the immediately preceding round are identical, an amount of the winnings being a fixed multiple of the amount of the wager or an entire amount of a progressive pot. U.S. Patent App. Pub. No. 2005/0192076, published Sep. 1, 2005, to Lowery, discloses a side bet for roulette that a player wins a fixed amount when a preselected outcome occurs in two consecutive rounds.

BRIEF SUMMARY

In some embodiments, methods of administering games of roulette may involve accepting a wager from a player. A random multiplier selection apparatus may be used to randomly select a multiplier from a group of fixed multipliers for a payout on the wager. A random outcome generation apparatus may be used to randomly generate a number and associated color from within a range of numbers and associated colors. The wager may be resolved by determining whether the randomly generated number is identical to a randomly generated number from an immediately preceding round. A payout may be paid to the player when the randomly generated number is identical to the randomly generated number from the immediately preceding round, an amount of the payout being equal to an amount of the wager multiplied by the randomly selected multiplier. The amount of the wager may be collected for the house when the randomly generated number is different from the randomly generated number from the immediately preceding round.

In other embodiments, methods of administering games of roulette may involve accepting a first wager from a player. Another wager may also be accepted from the player. A random multiplier selection apparatus may be used to randomly select a multiplier from a group of fixed multipliers consisting of 10 times, 25 times, 50 times, 100 times, 250 times, 500 times, and 1,000 times for a payout on the other wager. A random outcome generation apparatus may be used to randomly generate a number and associated color within a range of numbers and associated colors. The other wager may be resolved by determining whether the randomly generated number is identical to a randomly generated number from an immediately preceding round. A payout may be paid to the player when the randomly generated number is identical to the randomly generated number from the immediately preceding round. An amount of the payout may be equal to an amount of the other wager multiplied by the randomly selected multiplier. The amount of the other wager may be collected for the house when the randomly generated number is different from the randomly generated number from the immediately preceding round. The first wager may be resolved by comparing a characteristic of the randomly generated number and associated color with a characteristic associated with the first wager.

In other embodiments, gaming tables for administering games of roulette may include a playing surface including at least one player interface for at least one player position, an operator interface, and at least one processor. The at least one processor may be programmed to: accept a wager from a player; randomly select a multiplier from a group of fixed multipliers for a payout on the wager; randomly generate a number and associated color within a range of numbers and associated colors; resolve the wager by determining whether the randomly generated number is identical to a randomly generated number from an immediately preceding round; authorize payment of a payout to the player when the randomly generated number is identical to the randomly generated number from the immediately preceding round, an amount of the payout being equal to an amount of the wager multiplied by the randomly selected multiplier; and authorize collection of the amount of the wager for the house when the randomly generated number is different from the randomly generated number from the immediately preceding round.

In still other embodiments, methods of administering games of roulette over networks may involve receiving at a user interaction server authorization from a player to allocate funds to a wager. A multiplier may be randomly selected at a game server from a group of fixed multipliers for a payout on the wager. The game server may randomly generate a number and associated color within a range of numbers and associated colors. The wager may be resolved by determining at the game server whether the randomly generated number is identical to a randomly generated number from an immediately preceding round. The game server may authorize payment of a payout to the player when the randomly generated number is identical to the randomly generated number from the immediately preceding round. An amount of the payout may be equal to an amount of the wager multiplied by the randomly selected multiplier. The game server may authorize collection of the amount of the wager for the house when the randomly generated number is different from the randomly generated number from the immediately preceding round.

In other embodiments, methods of administering play-for-fun games of roulette over networks may include sending from a user interaction server a quantity of valueless wagering elements usable within a predetermined time period to a player. Authorization from a player may be received at the user interaction server to allocate at least one valueless wagering element to a wager. A game server may randomly select a multiplier from a group of fixed multipliers for a payout on the wager. The game server may randomly generate a number and associated color within a range of numbers and associated colors. The wager may be resolved by determining at the game server whether the randomly generated number is identical to a randomly generated number from an immediately preceding round. The game server may authorize issuance of additional valueless wagering elements to the player when the randomly generated number is identical to the randomly generated number from the immediately preceding round. A quantity of the additional valueless wagering elements may be equal to the quantity of valueless wagering elements allocated to the wager multiplied by the randomly selected multiplier. The game server may authorize deduction of the quantity of valueless wagering elements allocated to the wager when the randomly generated number is different from the randomly generated number from the immediately preceding round.

In yet other embodiments, methods of administering roulette games over networks may involve receiving at a user interaction server authorization from a player to receive a roulette wager and to receive a separate side bet wager on the occurrence of two consecutive identical game outcomes. The exact amount won is determined by randomly selecting a multiplier and applying the multiplier to the amount of the wager. A user interaction server may accept an election to make a roulette wager on a selection of a number and color combination within a range of number and color combinations from the player. The user interaction server may also receive a wager on the occurrence of a next number and color combination being identical to the last consecutive game outcome. After receiving an authorization to receive the side wager, a game server may randomly select a multiplier from a group of fixed multipliers for a payout on the side wager, prior to or while randomly selecting and displaying the next roulette game outcome. The game server may randomly generate a number and associated color within a range of numbers and associated colors. The game server may authorize payment of a payout to the player when the randomly generated number is identical to the randomly generated number from the immediately preceding round. An amount of the payout may be equal to an amount of the wager multiplied by the randomly selected multiplier. The wager may be resolved by comparing the number selected by the player to the randomly generated number and authorizing at the game server payment of a payout to the player.

Further embodiments may include one, some, or all of the following: The acts of the dealer or other operator may be carried out by a visual representation of a dealer, the visual representation being generated and/or displayed by a computer. The visual representation may be a virtual person (e.g., an animation), or may be a transmission (e.g., a video) of an actual person. The visual representation may be part of an online gaming experience of the disclosed game. The acts described in this disclosure associated with a dealer, including randomly generating a number and associated color (e.g., by introducing a ball onto a spinning roulette wheel or by activating an electronic random number generator), accepting or paying bets, or any other actions, may be represented in any way when used in an online environment. For example, the randomly generated numbers and associated colors generated by with a dealer action, described as being produced or otherwise initiated by a dealer, may appear as highlighted spaces on a virtual roulette wheel, as transmitted pictures of playing cards representing results achievable using a conventional physical roulette wheel, or as plain or colored text. This may include a display of a virtual roulette wheel where each space on the roulette wheel, with its associated number and color, is displayed to an online player in a manner consistent with the game play disclosed herein, but may or may not include a visual representation of a dealer with the roulette wheel. Likewise, betting activity may be displayed in any manner to a player, including, but not limited to, virtual chips, betting pools, numbers, or other indicia of a bet amount.

The online experience may involve players playing remotely (e.g., in a different physical location) from the dealer, remotely from the location of a game server, or remotely from both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment.

Live, electronic, or online implementations of the methods described in this disclosure may be configured for administration as either "play-for-pay" embodiments or "play-for-fun" embodiments. In play-for-pay embodiments, wagers having real-world monetary value are received and payouts having real-world monetary value may be distributed. Play-for-pay embodiments include "house-banked" embodiments and "player-banked" embodiments. In house-banked embodiments, payouts are paid by, and losses are retained by, the game administrator (e.g., a casino or other gaming establishment). Play-for-fun embodiments (e.g., "free play-for-fun" configurations and "social play-for-fun" configurations) involve receiving wagers having no real-world monetary value and distribute payouts having no real-world monetary value.

The actions described in this disclosure as the acts of a player, including betting and any other actions, may be carried out over a network where the indicated actions are received as input to a device. The input-receiving device is typically physically remote from the game server or game host and is connected over a long-distance network, but may also be implemented over a wired or wireless LAN in one building, or even in one room, for example. In one embodiment, game play generated at the server or host location may be displayed on the same device as the receiving device. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, touch screens, buttons, mice, optical location devices, eye movement/location detectors, sound input devices, etc. When discussing a device, it is understood the device may comprise multiple components and be complex, including hardware components combined with firmware and/or software, and may itself be a subcomponent of a larger system.

Yet other embodiments may comprise apparatuses and systems for administering wagering games according to embodiments of the disclosure.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
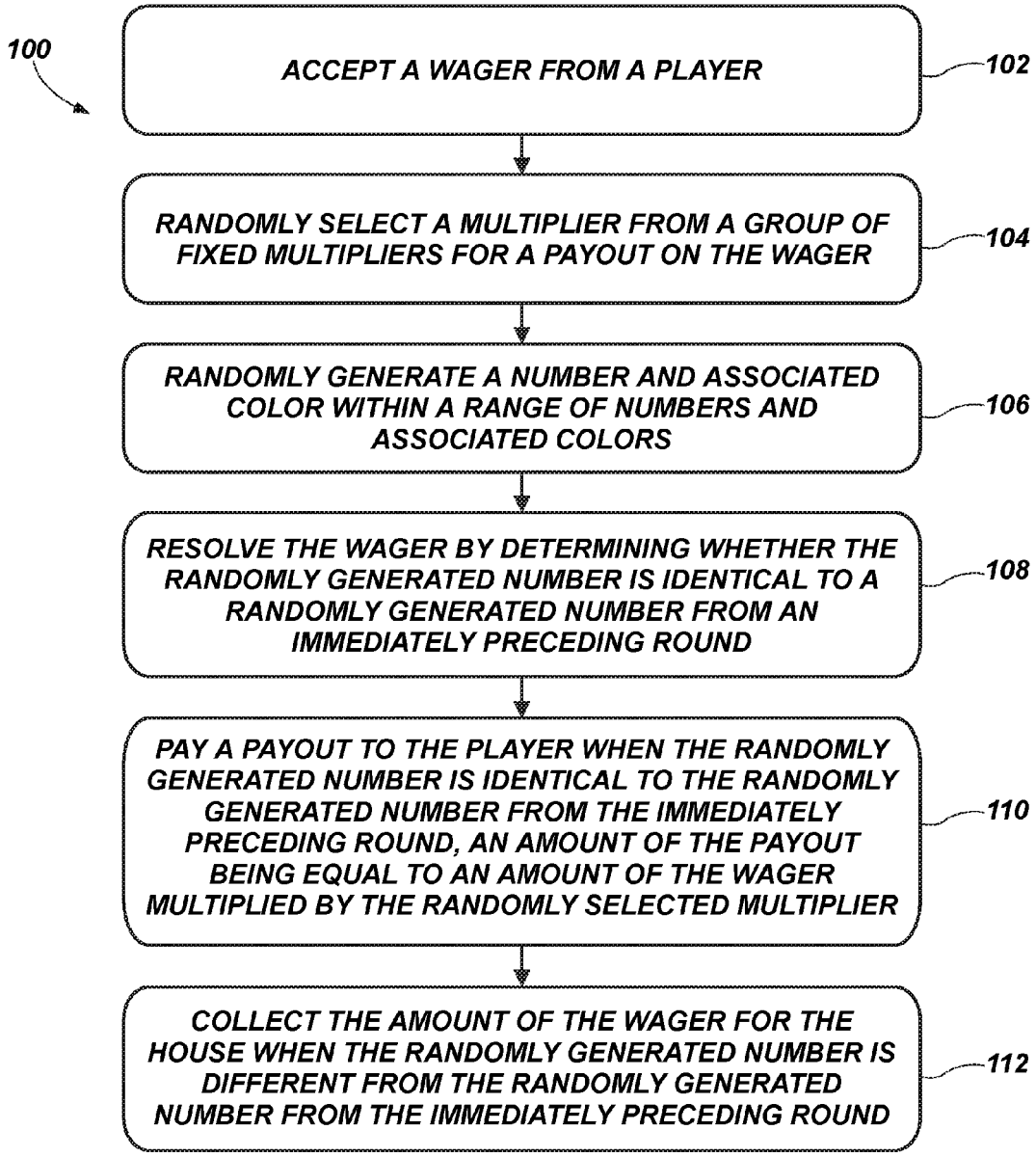
FIG. 1 is a flowchart diagram of a method of administering a wagering game, according to an embodiment of this disclosure.

The illustrations presented herein are not meant to be actual views of any particular act in a method of administering a wagering game, apparatus or system for use in administering a wagering game, or component thereof, but are merely idealized representations employed to describe illustrative embodiments. Thus, the drawings are not necessarily to scale. Additionally, elements common between figures may retain the same or similar numerical designations. Elements with the same number, but including a different alphabet character as a suffix should be considered as multiple instantiations of substantially similar elements and may be referred generically without an alphabet character suffix. For example, elements 100*a*, 100*b*, and 100*c*, may be a device that is instantiated three times and generically referred to herein as element 100.

The terms "gaming," "gambling," or the like, refer to activities, games, sessions, rounds, hands, rolls, operations, and other events related to wagering games such as web-based games, casino games, card games, dice games, and other games the outcome of which is at least partially based on one or more random events ("chance" or "chances"), and on wagers that which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay,") or in wagering games that involve no real-world monetary risks for the player (e.g., the "play-for-fun" and "social play-for-fun" configurations, which are described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local gaming table 126, 400, 470, or 500 (see FIGS. 5A, 5B, and 6), or electronic authorizations of a transfer of money or digital representations of money (e.g., digital representations of bills or coins, digital representations of chips, numerical quantities of money, numerical quantities of points, or numerical quantities of credits) at a local or remote electronic gaming device 300, 400, 470, 500, 620, or 640 (see FIGS. 4 through 8). In the "play-for-fun" and "social play-for-fun" configurations, a "wager" may not have a cash value (i.e., a real-world monetary value).

For the purposes of this description, it will be understood that when an action related to accepting wagers, making payouts, generating random events, selecting random event outcomes, or other actions associated with a player or a dealer are described, the description includes a player or a dealer taking the action, the results of the action on a live or virtual table or display, and, if applicable, the reception or detection of such an action in an electronic form where player and dealer choices, selections, or other actions are received at an electronic interface. This further includes the results of a virtual dealer and virtual players, where the actions described are actually generated by a computer (typically associated with an online game or computer-controlled electronic gaming platform). By way of a further example, if generating a random roulette outcome is described herein, the description includes (but is not limited to) the following: the introduction of an indicator (e.g., a ball) into a spinning roulette wheel and the indicator coming to rest on a number and its associated color; the generation and transmission of an electronic indication or representation of a number and its associated color from a game play source or server to an electronic receiver, where the receiver may be at a table (using virtual representations of a roulette wheel) including players and/or virtual players and/or a dealer or virtual dealer, at a public display in a casino, at a remote location (e.g., using online or Internet game play), or at other locations. Also included is the representation of a roulette layout, including betting areas, on a display or displays, and, if applicable to the action described, an electronic reception of an indication that a player has made a wager on a particular roulette outcome.

In some embodiments, the roulette wheel may be an animation or virtual representation of a roulette wheel. For example, an animation of a virtual roulette wheel may be displayed on a community electronic display. In other embodiments, a conventional roulette wheel may be used. The wheel may be automatically activated to start spinning, stop spinning or both. The wheel may be manually activated. The ball may be automatically activated, or manually activated. The entire physical wheel may be automatically activated, or manually activated. The wheel may be a "card wheel" that carries cards bearing the conventional number and color combinations found on a roulette wheel. Selection of a card may result in the wheel dispensing or displaying the selected card as the game outcome. An exemplary wheel is disclosed in U.S. Pat. No. 7,669,853, issued on Mar. 2, 2010, and titled "CARD SHUFFLING MACHINE," the disclosure of which is incorporated herein in its entirety by this reference.

In addition, the random generation of event outcomes may refer to revealing a representation of a payout multiplier or a roulette outcome on a scratch-off card (also referred to as "scratchers").

Devising effective new bets for roulette presents a particularly difficult challenge for game designers. More specifically, the sheer number of possible outcomes (i.e., 38 possible numbers, including 00 and 0 through 36, according to United States rules, or 37 possible numbers, including 0 through 36, according to European rules) and associated payout values make crafting a wager that is statistically profitable mathematically difficult. When payout values are randomized, their randomization further increases the complexity and difficulty of crafting a profitable wager. Moreover, strategic concerns regarding player perceptions render crafting a wager difficult. When players do not perceive a wager as offering the potential for rewards commensurate with the risk that the wagered amount will be lost, they may avoid the wager. Such wagers are frequently labeled "sucker bets." Accordingly, crafting a wager for roulette that is both profitable for the house and popular with players presents an extraordinary challenge.

Referring to FIG. 1, a flowchart diagram of a method 100 of administering a wagering game is shown. The method 100 may involve accepting a wager from a player, as indicated at 102. The wager may be, for example, an unconventional roulette wager (e.g., a bonus wager). The wager may be optional or mandatory. Making a wager on the basic roulette game may also be a requirement to participate in the side bet in embodiments where the wager accepted from the player is a side bet. A result of the wager may depend on at least two outcomes: the outcome of the round of roulette initiated with acceptance of the wager and the outcome of the immediately preceding round of roulette. The wager may be accepted, for example, by physically receiving money or a representation of money (e.g., a chip or token) on a designated betting area, by a processor receiving a signal from a user interface indicating a wager has been received, or by receiving electronic authorization to charge a player account (e.g., a credit account or a bank account). More specifically, the wager may be accepted, for example, by physically receiving chips within a wager area 130 on a playing surface 120 of a playing table 400, 470, or 500 (see FIGS. 2, 5A, 5B, and 6) or by receiving electronic authorization at a processor 350, 414, 428, 480, 597, or 642 (see FIGS. 4 through 6 and 8) to charge a player account via a player interface 332, 416, 532, 620, 650, or 654 (see FIGS. 4 through 6 and 8) or dealer interface 418 (see FIGS. 5A and 5B), where the player interface may be remotely located from the dealer or game server.

A multiplier may be randomly selected from a group of fixed multipliers for a payout on the wager, as indicated at step 104. The group of fixed multipliers may be a closed, unvarying set of values that may be multiplied by an amount of the wager to calculate an amount of a payout on the wager. For example, the group of fixed multipliers may consist of 10 times, 25 times, 50 times, 100 times, 250 times, 500 times, and 1,000 times. In certain embodiments, different multipliers may be included, and the group may include more or fewer total multipliers. Randomly selecting the multiplier from the group of fixed multipliers may involve, for example, activating a multiplier selection apparatus to randomly select the multiplier from the group of fixed multipliers. More specifically, a die having a multiplier displayed on each side of the die may be rolled, wherein when the die comes to rest the multiplier is selected, a wheel with a needle at a periphery of the wheel may be spun or a needle within a wheel having a multiplier displayed in each of several sections of the wheel may be spun, wherein the multiplier in the section where the needle points when the wheel or needle comes to rest is selected, or a random number generator may be activated and a result of the random number generator may be used to select the multiplier, such as by applying a formula to the random result. As specific, nonlimiting examples, the multiplier may be randomly selected from the group of fixed multipliers, for example, by physically rolling a die, spinning a wheel, or spinning a needle 128 on a playing surface 120 of a playing table 400, 470, or 500 (see FIGS. 2, 5A, 5B, and 6), by receiving electronic authorization at a processor 350, 414, 428, 480, 597, or 642 (see FIGS. 4 through 6 and 8) via a dealer interface 418 (see FIGS. 5A and 5B) to activate a random number generator (e.g., programmed into or otherwise operatively connected to the processor 350, 414, 428, 480, 597, or 642 (see FIGS. 4 through 6 and 8)) and automatically apply a formula, or by automatically, electronically activating a random number generator using a processor 350, 414, 428, 480, 597, or 642 (see FIGS. 4 through 6 and 8) and automatically applying a formula to select a random multiplier from among the group of fixed multipliers. By selecting the multiplier for the payout randomly, an element of chance may be injected into the wagering process, which may increase excitement for players.

In some embodiments, the random selection of the multiplier may be weighted such that some multipliers are more likely to be randomly selected than other multipliers. For example, lower multipliers may be more likely to be selected than higher multipliers. The group of fixed multipliers may be weighted, for example, by selecting a die that is not evenly balanced, selecting a wheel having sections that are not of equal size, selecting a wheel having more sections than there are multipliers and repeating certain multipliers, or including the desired weighting into the formula that is applied to automatically, electronically select a random multiplier. Weighting may be applied to cause, for example, 10 times to be selected with a theoretical average frequency of 32.05%, 25 times to be selected with a theoretical average frequency of 40%, 50 times to be selected with a theoretical average frequency of 19%, 100 times to be selected with a theoretical average frequency of 8%, 250 times to be selected with a theoretical average frequency of 0.75%, 500 times to be selected with a theoretical average frequency of 0.15%, and 1,000 times to be selected with a theoretical average frequency of 0.05%. As another example, weighting may be applied to cause 10 times to be selected with a theoretical average frequency of 32.55%, 25 times to be selected with a theoretical average frequency of 40%, 50 times to be selected with a theoretical average frequency of 20%, 100 times to be selected with a theoretical average frequency of 6.5%, 250 times to be selected with a theoretical average frequency of 0.75%, 500 times to be selected with a theoretical average frequency of 0.15%, and 1,000 times to be selected with a theoretical average frequency of 0.05%. By weighting the group of fixed multipliers, the wager may offer players the potential for large payouts, which may be enticing to the players, while maintaining profitability for the house, which may be attractive to casinos and other gaming establishments. Weighting each multiplier with a desired frequency allows the house to select a desired frequency and control the hold percentage of the wager. When the weighting is processor controlled, the processor may be programmed to change the weighting in response to inputs such as play frequency, average bet size, or other parameters. For example, a casino might choose to return a higher percentage of the wager made to the players during non-peak hours, but earn higher margins during peak hours.

In some embodiments, one or more additional wagers may be accepted from the player. For example, another wager selected from the group consisting of an odds, evens, red, black, split, box, high, low, first twelve, second twelve, third twelve, and specific number and associated color wager may be accepted from the player. Accepting another wager may be accomplished by performing any of the actions described previously in connection with accepting the wager 102.

A number and associated color within a range of numbers and associated colors may be randomly generated, as indicated at 106. For example, an outcome generation apparatus may be used to randomly generate a number from the group consisting of 00 and integers between 0 and 36, for American-style roulette, or from the group consisting of integers between 0 and 36, for European-style roulette. A preselected color may be associated with each number, such that randomly generating the number may also generate the color associated with the randomly generated number. For example, red or black may be associated with integers from 1 to 36, with equal quantities of numbers being red and black, and green may be associated with 0 and 00. According to an embodiment, each number is associated with only one number such that there is only one occurrence of a number in the entire set of numbers. For example, the number four (4) may only occur as a black number in the set. Randomly generating the number and associated color may involve, for example, introducing a ball onto a spinning roulette wheel, wherein the number and associated color are generated by permitting the ball to come to rest at a segregated location in which the number and associated color are displayed, or activating a random number generator and using a result of the random number generator to select the number and associated color. More specifically, the number and associated color may be randomly generated, for example, by physically introducing a ball onto a physical spinning roulette wheel 406 on a playing surface 120 of a playing table 400, 470, or 500 (see FIGS. 2, 5A, 5B, and 6), by receiving electronic authorization at a processor 350, 414, 428, 480, 597, or 642 (see FIGS. 4 through 6 and 8) via a dealer interface 418 (see FIGS. 5A and 5B) to activate a random number generator (e.g., programmed into or otherwise operatively connected to the processor 350, 414, 428, 480, 597, or 642 (see FIGS. 4 through 6 and 8) and automatically apply a formula, or by automatically, electronically activating a random number generator using a processor 350, 414, 428, 480, 597, or 642 (see FIGS. 4 through 6 and 8) and automatically applying a formula to generate a random number and associated color from within the range of numbers and associated colors.

The wager may be resolved by determining whether the randomly generated number is identical to a randomly generated number from an immediately preceding round, as indicated at 108. For example, the outcome of the immediately preceding round may be recorded and stored for comparison to the subsequent round. More specifically, the outcome of the immediately preceding round may be physically written down by a dealer, entered for electronic storage in memory 340, 440, 490, 595, 646, or 648 (see FIGS. 4 through 6 and 8) via a dealer interface 418 (see FIGS. 5A and 5B), or automatically, electronically stored in memory 340, 440, 490, 595, 646, or 648 (see FIGS. 4 through 6 and 8) when the outcome of the immediately preceding round has been generated. In some embodiments, the outcome of the immediately preceding round and additional historical information about the game of roulette may be displayed to the player using, for example, the techniques disclosed in U.S. patent application Ser. No. 13/631,598, filed Sep. 28, 2012, for "SYSTEMS, METHODS, AND DEVICES FOR DISPLAYING HISTORICAL ROULETTE INFORMATION," the disclosure of which is incorporated herein in its entirety by this reference. The randomly generated number from the current round may be compared to the randomly generated number from the immediately preceding round, for example, by visually comparing the outcome of the current round to the outcome written down by the dealer, visually comparing the outcome of the current round to an electronically stored and displayed outcome of the immediately preceding round, or automatically, electronically accessing the stored outcome from the immediately preceding round using a processor 350, 414, 428, 480, 597, or 642 (see FIGS. 4 through 6 and 8) and comparing it to the outcome of the current round.

A payout may be paid to the player when the randomly generated number is identical to the randomly generated number from the immediately preceding round, as indicated at operation 110. An amount of the payout may be equal to an amount of the wager multiplied by the randomly selected multiplier, as further indicated at 110. For example, the amount of the payout may be calculated by multiplying the randomly selected multiplier by the amount originally accepted for the wager. More specifically, the amount of the payout may be calculated by multiplying the randomly selected multiplier by the amount of the wager using a processor 350, 414, 428, 480, 597, or 642 (see FIGS. 4 through 6 and 8).

The multiplier may be displayed on a common game display, such as an upright video display, after the wagers on the bet are made. Displaying the multiplier after the wagers are made adds mystery and excitement to the game. Displaying the multiplier in advance of displaying the game outcome also adds anticipation and further enjoyment to the game.

Paying the payout may involve, for example, physically giving money or chips, crediting a win meter, or granting electronic authorization to transfer funds to a player account. More specifically, the payout may be paid, for example, by physically giving chips to a player on a playing surface 120 (see FIG. 2) of a playing table 400 or 470 (see FIGS. 5A and 5B), by receiving electronic authorization at a processor 350, 414, 428, 480, 597, or 642 (see FIGS. 4 through 6 and 8) via a dealer interface 418 (see FIGS. 5A and 5B) to transfer funds from an account server 610 (see FIG. 6) to a player account, or automatically generating electronic authorization at the processor 350, 414, 428, 480, 597, or 642 (see FIGS. 4 through 6 and 8) to transfer funds from an account server 610 to a player account (see FIG. 7).

The amount of the wager may be collected for the house when the randomly generated number is different from the randomly generated number from the immediately preceding round, as indicated at 112. Collecting the amount of the wager may be accomplished, for example, by physically retrieving money or chips, decrementing credits from a player credit meter, or granting electronic authorization to transfer funds to a house account. More specifically, collecting the amount of the second wager may be accomplished, for example, by physically retrieving chips from the playing surface 120 (see FIG. 2) of a playing table, receiving electronic authorization at a processor 350, 414, 428, 480, 597, or 642 (see FIGS. 4 through 6 and 8) via a dealer interface 418 (see FIGS. 5A and 5B) to transfer funds from a player account to an account server 610 (see FIG. 7), or automatically generating electronic authorization at the processor 350, 414, 428, 480, 597, or 642 (see FIGS. 4 through 6 and 8) to transfer funds from the player account to a house account server 610 (see FIG. 8).

Payouts may be paid on any additional wagers when a characteristic of the randomly generated number and associated color is the same as the characteristics associated with the additional wagers. The amounts of any additional wagers may be collected for the house when the characteristic of the randomly generated number and associated color is different from the characteristics associated with the additional wagers. Paying the payouts and collecting the additional wagers may be accomplished by performing any of the actions described previously in connection with paying the payout on the wager 110 and collecting the amount of the wager 112.

Various platforms are contemplated that are suitable for implementation of embodiments of wagering games according to the present disclosure. For example, embodiments of wagering games may be implemented such that wagers may be received from one or more players, and game play may be administered with the one or more players according to the rules of the wagering games. For example, wagering games may be implemented on gaming tables, which may include physical gaming features, such as physical cards and physical chips, and may include a live dealer and a physical roulette wheel. More specifically, a live dealer may spin the wheel, launch the ball (or electronically activate the wheel, ball or both), handle physical cards when a "card wheel" is used, evaluate hands, accept wagers, accept player elections, issue payouts, and perform other administrative functions of game play. Some embodiments may be implemented on electronic devices enabling electronic gaming features, such as providing electronic displays for display of virtual cards, virtual chips, game instructions, pay tables, etc. Some embodiments may include features that are a combination of physical and electronic features.

As an example, embodiments of wagering games may be implemented on an individual gaming device, such as a video poker machine, configured to accept wagers and having a display screen and input devices for enabling game play of the wagering games. Such an individual gaming device may be linked with other gaming devices that may be operated, for example, by other players. Some individual electronic gaming devices may be referred to as an individual player "electronic gaming machine" (hereinafter "EGM") and may be stationary, such as being located on a casino floor. Other individual electronic gaming devices may be portable devices that may be carried to different locations by the player. Portable devices may include both display of the ongoing game play and input reception for game play by a player. Portable devices may, alternatively or additionally, be configured for receiving input from a player while the game play is displayed on a public monitor or other display device. Game play and game outcomes may also be displayed on a portable device.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, or on a legally-authorized site on the Internet.

For example, in one embodiment, the players may be remotely located from a live dealer, and a live dealer and a game table may be displayed to players on their monitors via a video feed. The players may or may not have video feeds that may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference, and in connection with FIGS. 7 and 8.

Figure 2:
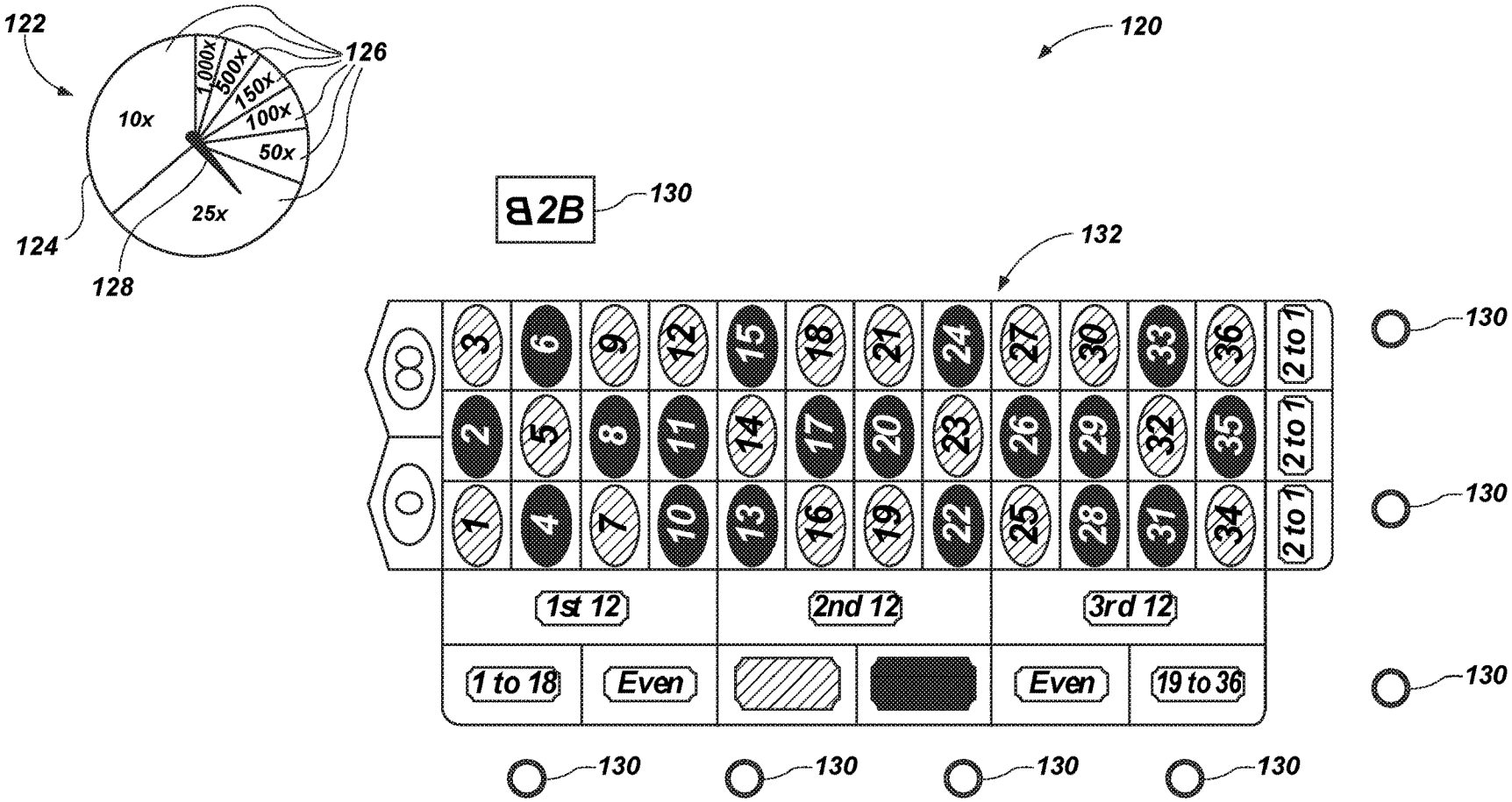
FIG. 2 is a diagram of a playing surface for implementation of a method of administering a wagering game, according to an embodiment of the present disclosure.

Referring to FIG. 2, shown is a diagram of a playing surface 120 for implementation of wagering games such as roulette and roulette variants within the scope of the present disclosure. Such an implementation may be a felt layout on a physical gaming table (not shown) or an electronic representation on a video display 374, 416, 430, 532, 564, 560, 620, or 658 (see FIGS. 4 through 8). The playing surface 120 may include a multiplier selection area 122, which may be configured for the random selection of a multiplier from a group of fixed multipliers to calculate a payout on a wager, or for the display of the result. The multiplier selection area 122, as shown in FIG. 2, may include a wheel 124 divided into sections 126, each of which may display one of the fixed multipliers. Sections 126 displaying lower multipliers may be larger than sections 126 displaying higher multipliers to weight the random selection in favor of lower multipliers without precluding the occurrence of large payouts. A spinnable needle 128 may be rotatably attached to the playing surface 120 at a center of the wheel 124, and may be spun to randomly select a multiplier. In other embodiments, the multiplier selection area 122 may include, for example, a spinnable wheel with a fixed needle at a periphery of the wheel, an area in which a die can be rolled, or an electronic display for displaying text and images, which may include animation of a wheel or a rolling die or simple display of the randomly selected multiplier. The playing surface 120 may include wager areas 130 at multiple player positions in which acceptance of the wager 102 (see FIG. 1) may be reflected. For example, physical money or chips may be received in the wager area 130, or images of money or chips or numbers and text may be electronically displayed in the wager area 130, to show acceptance of the wager.

In some embodiments, an electronic bet sensor (not shown) is provided to electronically recognize the placement of a chip of a fixed denomination. In other embodiments, the chip sensor can determine the denomination of the chip. In some embodiments, the wager can be any size within house limits.

The playing surface 120 may further include another wager area 132, in which other wagers such as traditional roulette wagers may be accepted. The other wager area 132 may be the same as or similar to wagering areas described in U.S. patent application Ser. No. 13/631,598, filed Sep. 28, 2012, for "SYSTEMS, METHODS, AND DEVICES FOR DISPLAYING HISTORICAL ROULETTE INFORMATION." Briefly, the other wagering area 132 may be configured for acceptance of odds, evens, red, black, split, box, specific number and color, and other roulette bets. In some embodiments, the playing surface 120 may include a display for electronically showing the outcome of randomly generating the number and associated color 106 (see FIG. 1) or a roulette wheel 406 (see FIGS. 5A and 5B) into which a ball may be introduced to randomly generate the number and associated color.

Figure 3:
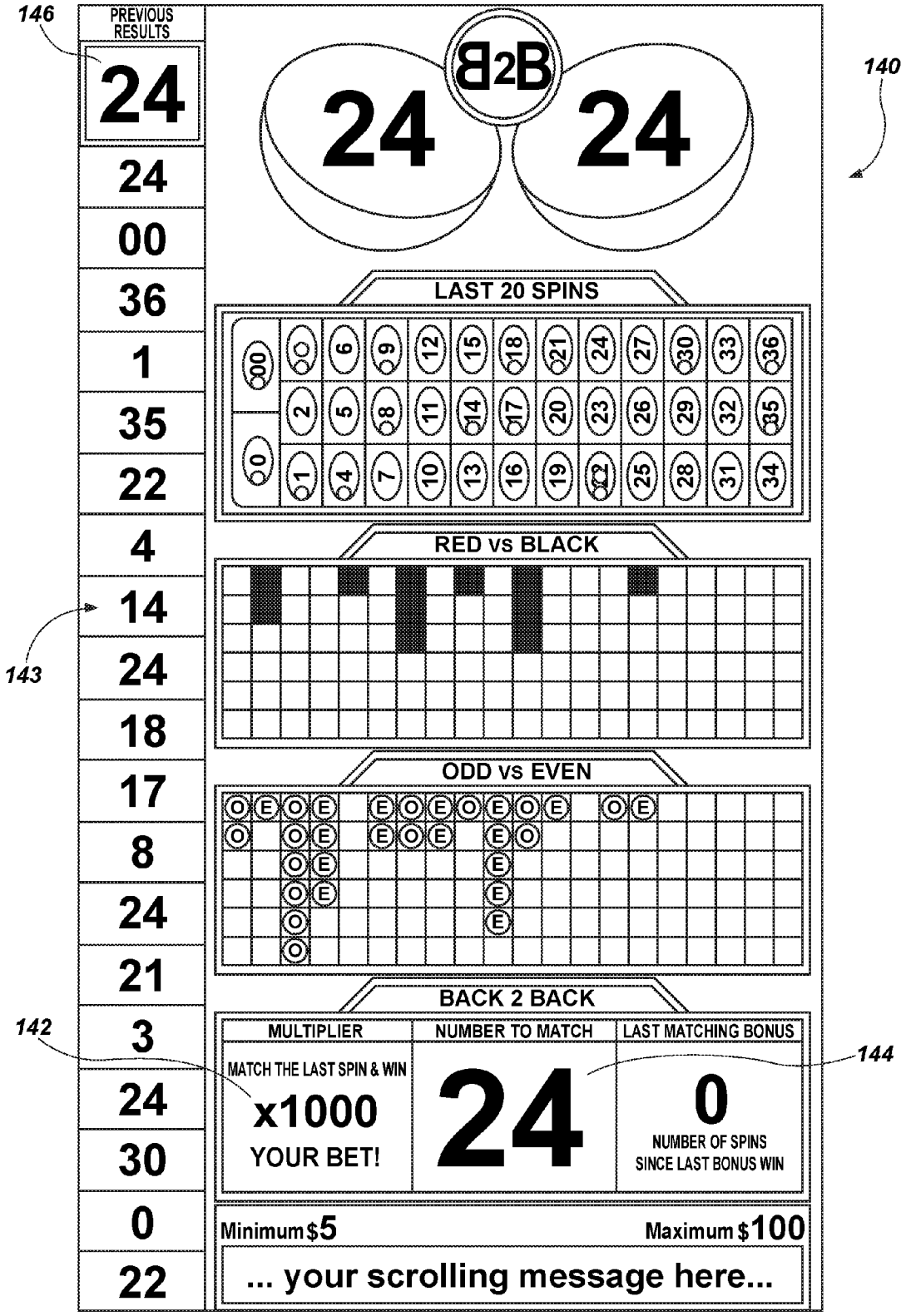
FIG. 3 is a diagram of another playing surface for implementation of a method of administering a wagering game, according to another embodiment of the present disclosure.

Referring to FIG. 3, illustrated is a diagram of an upright video display that may be used in connection with a playing surface 120 for implementation of a method of administering a wagering game, according to another embodiment of the present disclosure. Such an implementation may be a traditional roulette game utilizing a felt surface 120 as shown in FIG. 2, an electronic representation on a video display 374, 416, 430, 532, 564, 560, 620, or 658 (see FIGS. 4 through 8).

The video display may include a display surface 140. The display surface 140 may include a multiplier selection area 142, which may be, for example, a section of a display electronically showing the result of the random selection of the multiplier in images, text, or images and text. The display surface 140 may display historical information on the outcomes of the game of roulette in multiple formats, as described in U.S. patent application Ser. No. 13/631,598, filed Sep. 28, 2012, for "SYSTEMS, METHODS, AND DEVICES FOR DISPLAYING HISTORICAL ROULETTE INFORMATION." Briefly, the display surface 140 may display the numbers and colors for the current and preceding outcomes and may visually represent streaks in specific outcomes (e.g., 24 black, 36 red, etc.) and characteristics of outcomes (e.g., odds, evens, red, black, green). The display surface 140 may have a vertical column 143 of historical game outcomes, in the order in which the outcomes occurred, the newest being at the top of the column. The display surface 140 may include an immediately preceding outcome area 144, which may display the outcome to be repeated for a player to win the wager 110 (see FIG. 1). The display surface 140 may further include an outcome area 146 within area 143, which may display the outcome of the current round of the game of roulette.

In some embodiments, the wagering games described herein may be played against the game administrator, i.e., "the house" (i.e., be "house-banked"), which may involve the game administrator (e.g., a casino or other gaming establishment) receiving (via a dealer who may be employed by the administrator) wagers having real-world monetary value, comparing a player hand against a dealer hand, distributing payouts having real-world monetary value to winning players, and retaining lost wagers. For example, and referring collectively to FIGS. 2 and 3, a wager may be accepted from a player, which may be reflected by the presence of a chip or an image of a chip in the wager area 130. A multiplier may be randomly selected from a group of fixed multipliers for a payout on the wager, which may be reflected, for example, by a needle 128 coming to rest and pointing toward a section 126 with its displayed multiplier or by electronically displaying the randomly selected multiplier in text, images, or text and images in a multiplier selection area 142 of an electronic display. A number and associated color may be randomly generated from within a range of numbers and associated colors, which may be reflected, for example, by a ball coming to rest in a section of a physical roulette wheel 406 (see FIGS. 5A and 5B) or by electronically displaying the randomly generated number and associated color in text, images, or text and images in an outcome area 146 of an electronic display.

The wager may be resolved by determining whether the randomly generated number is identical to a randomly generated number from an immediately preceding round. A payout may be paid to the player when the randomly generated number is identical to the randomly generated number from the immediately preceding round, an amount of the payout being equal to an amount of the wager multiplied by the randomly selected multiplier. Payment of the payout may be reflected by the transfer of chips to a player, credits added to a meter on a gaming device, or funds credited to a player account. The amount of the wager may be collected for the house when the randomly generated number is different from the randomly generated number from the immediately preceding round, which may be reflected by the transfer of chips to a dealer or of funds to a house account. Such embodiments may be implemented in the form of a live table game, a hybrid game utilizing a conventional roulette wheel on a table having electronic wagering interfaces, such as the system shown in U.S. Design Patent D663785 issued Jul. 17, 2012 (the content which is hereby incorporated by reference in its entirety), in a virtual table game, in an electronic game, or in an online game configuration.

As another specific, nonlimiting example, a method of administering a game of roulette may involve accepting a first wager from a player. Another wager 102 (FIG. 1) may also be accepted from the player. The other wager 102 may be a mandatory wager or an optional side wager. Upon receipt of the another wager 102, a multiplier may be randomly selected from a group of fixed multipliers consisting of 10 times, 25 times, 50 times, 100 times, 250 times, 500 times, and 1,000 times for a payout on the another wager. A dealer may use a dealer input to generate a signal to a processor indicating a player has placed another wager 102. In other embodiments, the system automatically generates a multiplier regardless of whether any another wagers 102 are in play.

A number and associated color may be randomly generated within a range of numbers and associated colors. In an embodiment, the total number and color combinations in the set of outcomes from which the game outcome may be randomly generated corresponds to the pockets in a conventional roulette wheel. The other wager may be resolved by determining whether the randomly generated number is identical to a randomly generated number from an immediately preceding round. A payout may be paid to the player when the randomly generated number is identical to the randomly generated number from the immediately preceding round. An amount of the payout may be equal to an amount of the other wager multiplied by the randomly selected multiplier. The amount of the other wager may be collected by the house when the randomly generated number is different from the randomly generated number from the immediately preceding round. The first wager may be resolved by comparing a characteristic of the randomly generated number and associated color with a characteristic associated with the first wager. For example, a player may place a chip on an area of a layout 120 indicating a wager, such as betting $5.00 on a black 10.

In some embodiments, wagering games may be administered without players risking money in connection with the wagers (i.e., "play-for-fun" games). Such games may be offered as online games, or as PC games such as those offered for downloading, or offered on a CD-ROM disc, for example. When a play-for-fun game is administered online, access to play-for-fun wagering games may be granted on a time period basis in some embodiments. An exemplary online gaming platform suitable for administering play of a play-for-fun game is described more fully below with reference to FIGS. 7 and 8. For example, upon initially joining the online wagering game, each player may automatically be assigned a plurality of wagering elements, such as, for example, chips, points, or simulated currency, that is of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time another quantity of the wagering elements may be distributed to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., the wager described in connection with acts 102, 108, and 110 of FIG. 1 and the other wagers described in connection with area 132 of FIG. 2) of no real-world monetary value, and payouts (e.g., the payout described in connection with act 110 of FIG. 1 and any payouts on the other wagers) may be paid without transferring real-world monetary value to the players. Such embodiments, referred to herein as "play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

As a specific, nonlimiting example, a free play-for-fun wagering game may comprise issuing a quantity of valueless wagering elements usable within a predetermined time period to a player. A player decision to allocate at least one valueless wagering element to a wager may be accepted. A multiplier may be randomly selected from a group of fixed multipliers for a payout on the wager. A number and associated color may be generated from within a range of numbers and associated colors. The wager may be resolved by determining at the game server whether the randomly generated number is identical to a randomly generated number from an immediately preceding round. Additional valueless wagering elements may be issued to the player when the randomly selected game number and color combination is identical to the randomly selected game number and color combination from the immediately preceding round. A quantity of the additional valueless wagering elements issued to the player may be equal to the quantity of valueless wagering elements allocated to the wager multiplied by the randomly selected multiplier. The quantity of valueless wagering elements allocated to the wager may be deducted when the randomly generated number is different from the randomly generated number from the immediately preceding round. A new quantity of valueless wagering elements usable within a new predetermined time period may be issued to the player, without the player exchanging anything, when the predetermined time period has lapsed.

As another specific, nonlimiting example, a social play-for-fun wagering game may comprise issuing a quantity of valueless wagering elements usable within a predetermined time period to a player. A player decision to allocate at least one valueless wagering element to a wager may be accepted. A multiplier may be randomly selected from a group of fixed multipliers for a payout on the wager. A number and associated color may be generated from within a range of numbers and associated colors. The wager may be resolved by determining at the game server whether the randomly generated number is identical to a randomly generated number from an immediately preceding round. Additional valueless wagering elements may be issued to the player when the randomly generated game outcome is identical to the randomly generated game outcome from the immediately preceding round. A quantity of the additional valueless wagering elements issued to the player may be equal to the quantity of valueless wagering elements allocated to the wager multiplied by the randomly selected multiplier. The quantity of valueless wagering elements allocated to the wager may be deducted when the randomly generated number is different from the randomly generated number from the immediately preceding round. A new quantity of valueless wagering elements usable within a new predetermined time period may be issued to the player, by accepting the player's redemption of an access token of no redeemable face value before the predetermined time period has lapsed.

Figure 4:
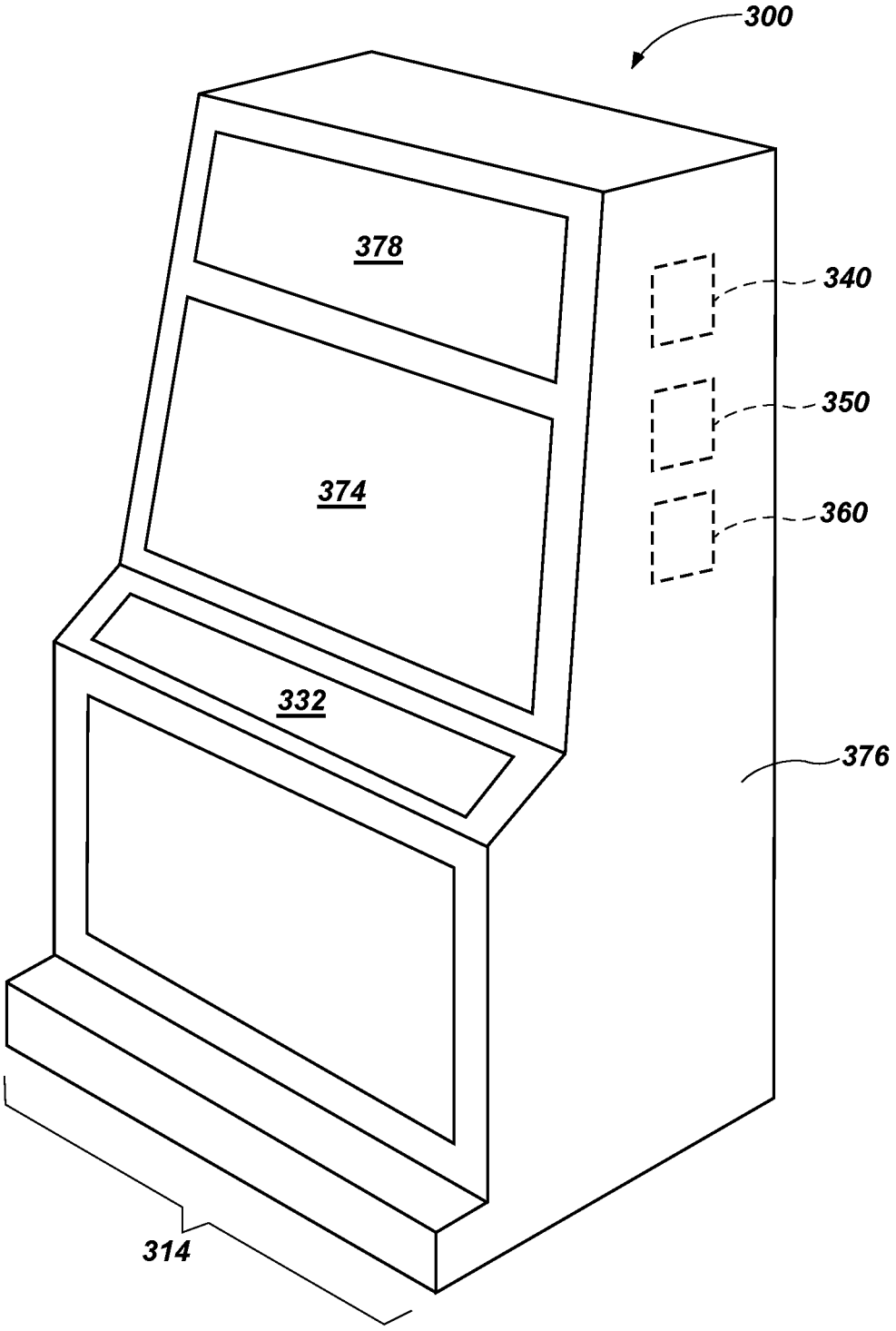
FIG. 4 is a perspective view of an individual electronic gaming device configured for implementation of embodiments of wagering games in accordance with the present disclosure.

Referring to FIG. 4, illustrated is an example of an individual electronic gaming device 300 (e.g., an electronic gaming machine (hereinafter, an "EGM") configured for implementation of embodiments of wagering games according to the present disclosure. The individual electronic gaming device 300 may include an individual player position 314 that includes a player input area 332 configured to enable a player to interact with the individual electronic gaming device 300 through various input devices. The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving a physical wheel, a physical ball or live personnel. The action may instead be simulated by a control processor 350 operably coupled to the memory 340 and interacting with and controlling the individual electronic gaming device 300. The EGM may also function as a player terminal to participate in a multi-player game administered by a dealer, the system having a community game outcome determining device, such as a roulette wheel. The system may have a community display for displaying game outcomes (not shown). An example of a suitable multi-player system is disclosed in U.S. Pat. No. 6,659,866.

Although the figure has an outline of a traditional gaming cabinet, the individual electronic gaming device 300 may be implemented in any number of ways, including, but not limited to, client software downloaded to a portable device, such as a smart phone, tablet, or laptop personal computer. The individual electronic gaming device 300 may also be a non-portable personal computer (e.g., a desktop or all-in-one computer) or other computing device. In some embodiments, client software is not downloaded but is native to the device or is otherwise delivered with the device when distributed to a player.

A communication device 360 may be included and operably coupled to the processor 350 such that information related to operation of the individual gaming device 300, information related to the game play, or combinations thereof may be communicated between the individual gaming device 300 and other devices (not shown) through a suitable communication media, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown), and speakers (not shown) for transmitting and/or receiving sounds during game play. Further detail of an example of an individual electronic gaming device 300 (as well as other embodiments of tables and devices) is disclosed in U.S. patent application Ser. No. 13/215,156, filed Aug. 22, 2011, published as U.S. Patent Publication No. 2013/0053117 on Feb. 28, 2013, and titled "METHODS OF MANAGING PLAY OF WAGERING GAMES AND SYSTEMS FOR MANAGING PLAY OF WAGERING GAMES," the disclosure of which is incorporated herein in its entirety by this reference.

Some embodiments may be implemented at locations that include a plurality of player stations. Such player stations may include an electronic display screen for display of game information, such as displaying a virtual roulette wheel, virtual chips, credit meters, win amounts, wagers made and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual roulette wheel, virtual chips, etc.), some features may remain in the physical domain. As such, the game play may be administered by a live dealer, a virtual dealer, or a combination of both.

Figure 5A:
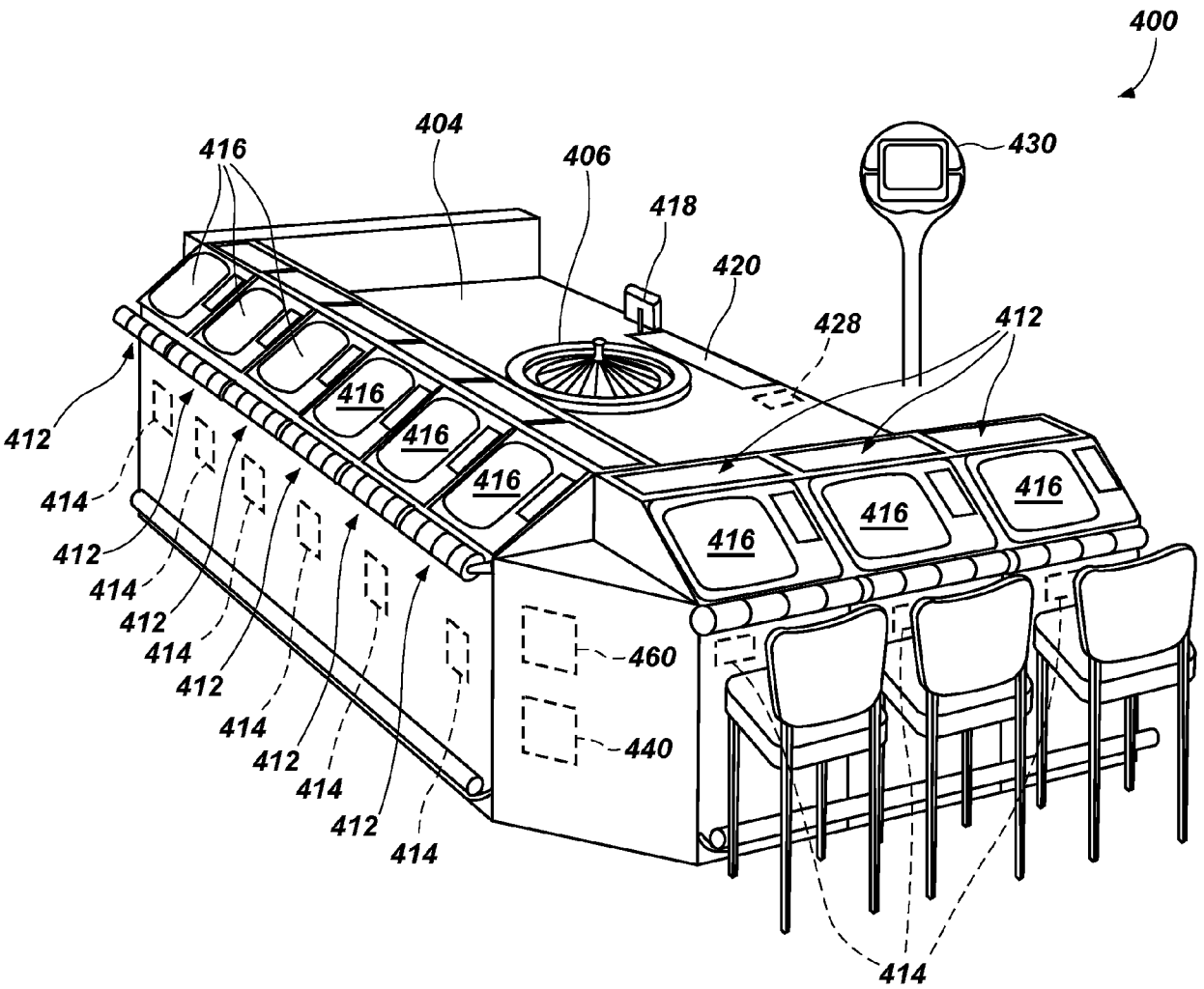
FIG. 5A is a top view of a table configured for implementation of embodiments of wagering games in accordance with the present disclosure.

Referring to FIG. 5A, an example of a suitable table 400 configured for implementation of embodiments of wagering games according to the present disclosure is shown. The table 400 may include a playing surface 404, which may be, for example, a felt surface with a roulette wheel 406 mounted into the surface 404. The felt surface may include printed graphics or other information useful to the players or dealer. Embodiments (not shown) may enable players to make wagers with chips or other currency on the playing surface 404. In the displayed embodiment, only credit wagering is enabled. In embodiments that permit wagering on a community playing surface (not shown), credit wagering may also be enabled on individual player interfaces or a community display.

When a community display is provided, a touchscreen surface may be used for display of, and in some embodiments, interaction with, information regarding the wagering game (e.g., wagers accepted, historical information, current round information, etc., as described previously in connection with FIGS. 2 and 3).

The table 400 as shown in FIG. 5A may include a plurality of player stations 412. Each player station 412 may include a separate player interface 416, which may be used for accepting wagers, displaying game information (e.g., game instructions, input options, wager information including virtual chips, game outcomes, etc.). The player interface 416 may include a display screen in the form of a touch screen, which may be at least substantially flush with, or raised up from, the playing surface 404 in some embodiments. Each player interface 416 may be coupled respectively with its own local game processor 414 (shown in dashed lines), although, in some embodiments, a central game processor 428 (shown in dashed lines) may be employed and may communicate directly to player interfaces 416. In some embodiments, a combination of individual local game processors 414 and the central game processor 428 may be employed.

A communication device 460 and a non-transitory memory 440 may be included and may be operably coupled to one or more of the local game processors 414, the central game processor 428, or combinations thereof, such that information related to operation of the table 400, information related to the game play, or combinations thereof may be communicated between the table 400 and other devices (not shown) through a suitable communication media, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using virtual chips. For embodiments using physical roulette wheels 406, the table 400 may further include a spinning, physical roulette wheel 406 that may be configured to receive a ball or other indicator which may come to rest in individual, separate sections with numbers and colors therein to generate a random outcome for a round of roulette. For embodiments using virtual roulette outcome generation, the outcome may be displayed at the individual player interfaces 416 or on a common display 430.

The table 400 may further include a dealer interface 418, which, like the player interfaces 416, may include touch screen controls for assisting the dealer in administering the wagering game. The table 400 may further include an upright common display 430 configured to display images that depict game information, such as, for example, the information described previously in connection with FIGS. 2 and 3 and a wide variety of other information considered useful to the players, including a video display of each game outcome, in real-time. A camera (not shown) may be trained on the wheel 406 and video recordings of each wheel spin may be captured and displayed on the display 430. The upright display 430 may be double sided to provide such information to players as well as to the casino pit.

Further detail of an example of a table and player displays is disclosed in U.S. Pat. No. 6,659,866, issued Dec. 9, 2003, for "AUTOMATIC TABLE GAME," the disclosure of which is incorporated herein in its entirety by this reference. Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

Figure 5B:
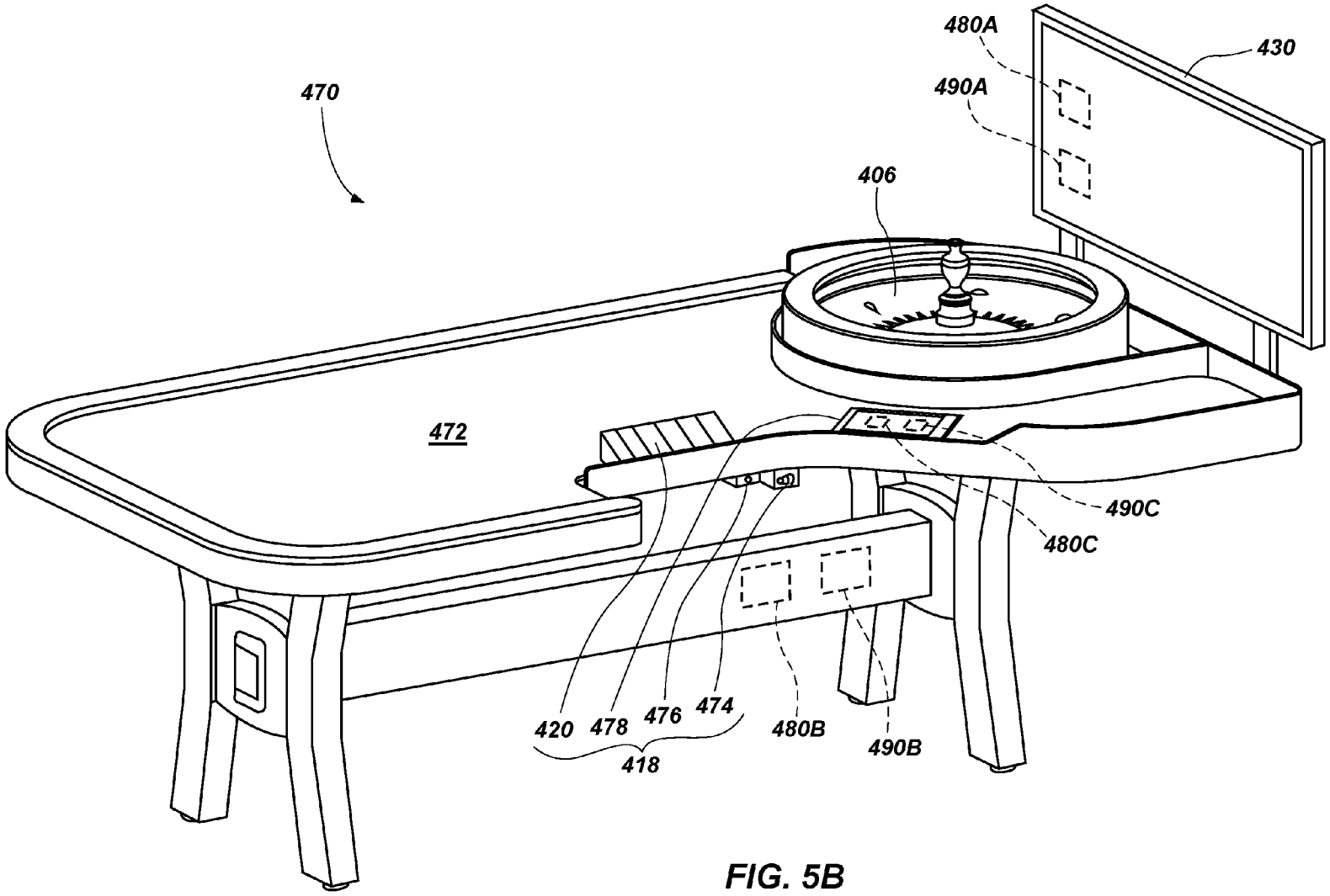
FIG. 5B is a perspective side view of another embodiment of a table configured for implementation of embodiments of wagering games in accordance with the present disclosure.

Referring to FIG. 5B, illustrated is a perspective side view of another embodiment of a table 470 configured for implementation of embodiments of wagering games in accordance with the present disclosure. The table 470 may include a playing surface 472, which may be, for example, a felt layout similar to the playing surface 120 described previously in connection with FIG. 2. The table 470 may further include a physical roulette wheel 406 proximate to, and in some embodiments supported by, the playing surface 472. The table 470 may include a video display 430 configured to display game information, such as, for example, the information described previously in connection with FIGS. 2 and 3 and any other information considered useful to the players, including acceptance of wagers, game outcomes, wager outcomes, payout multipliers, historical game outcome data, and other information, in real-time.

The table 470 may include features for at least partially automating administration of a wagering game using the table 470. For example, the table 470 may include a dealer interface 418, which may enable an in-person administrator (e.g., a dealer) to initiate automated administration of certain actions and to personally perform other actions associated with administering a wagering game. The dealer interface 418 may include, for example, a dealer chip tray 420, which may be configured to support house chips, to which lost wager may be added, and from which payouts may be paid. The dealer interface 418 may include a player authenticator 474 (e.g., a magnetic strip reader for cards carrying player information encoded on a magnetic strip), which may be configured to verify the identity of a player and grant access to a player account for the purpose of paying payouts, granting complimentary items and services (i.e., "comps") to players, redeeming chips for monetary value and vice versa, or performing other actions requiring a player's verified identity. The dealer interface 418 may include game initiation and control devices, such as, for example, buttons 476 and touchscreens 478, which may be configured to initiate random game events (e.g., random payout multiplier selection), verify authorization for large payout awards, enter wagering or outcome information for the purpose of game tracking, activating and deactivating automated portions of game administration (e.g., turning the table 470 and associated components on and off), and performing other actions to initiate and control the automatic administration of the wagering game.

The table 470 may include at least one processor 480, which may be associated, for example, with the video display 430 (e.g., processor 480A), the table 470 itself (e.g., processor 480B), or the touchscreen 478 (e.g., processor 480C) of the dealer interface 418. The one or more processors 480 may access game rules and game assets (e.g., videos, images, and text) stored in at least one nontransitory memory 490, which may similarly be associated, for example, with the video display 430 (e.g., memory 490A), the table 470 itself (e.g., memory 490B), or the touchscreen 478 (e.g., memory 490C) of the dealer interface 418. For example, the one or more processors 480 may randomly select a payout multiplier, interpret a random game outcome, declare winning wager conditions, and control display of information on the video display 430.

At least some of the actions performed in connection with administering a wagering game using the table 470 may be accomplished by an in-person administrator. For example, wagers may be accepted by a dealer permitting a player to place a chip in a designated area on the playing surface 472, roulette outcomes may be randomly generated by the dealer introducing an indicator (e.g., a ball) into the spinning physical roulette wheel 406 and permitting it to come to rest on a space defined by the physical roulette wheel 406, and payouts may be paid by the dealer giving chips from a dealer chip tray 420 to a player, for example, by placing them on the playing surface 472 proximate the player. Other actions performed in connection with administering a wagering game using the table 470 may be accomplished automatically by one or more processors 480, which may occur in response to dealer input or may occur automatically in response to other game events. For example, one or more processors 480 may randomly select a payout multiplier in response to a dealer indicating that wagering is closed, may automatically select a payout multiplier randomly at the close of wagering or at the beginning of a new round of play, may automatically interpret a random game outcome (e.g., using sensors in the physical roulette wheel 406 or using imaging sensors configured to capture information from the physical roulette wheel 406), and may apply game rules and display all winning game conditions associated with the random game outcome on the video display 430.

Figure 6:
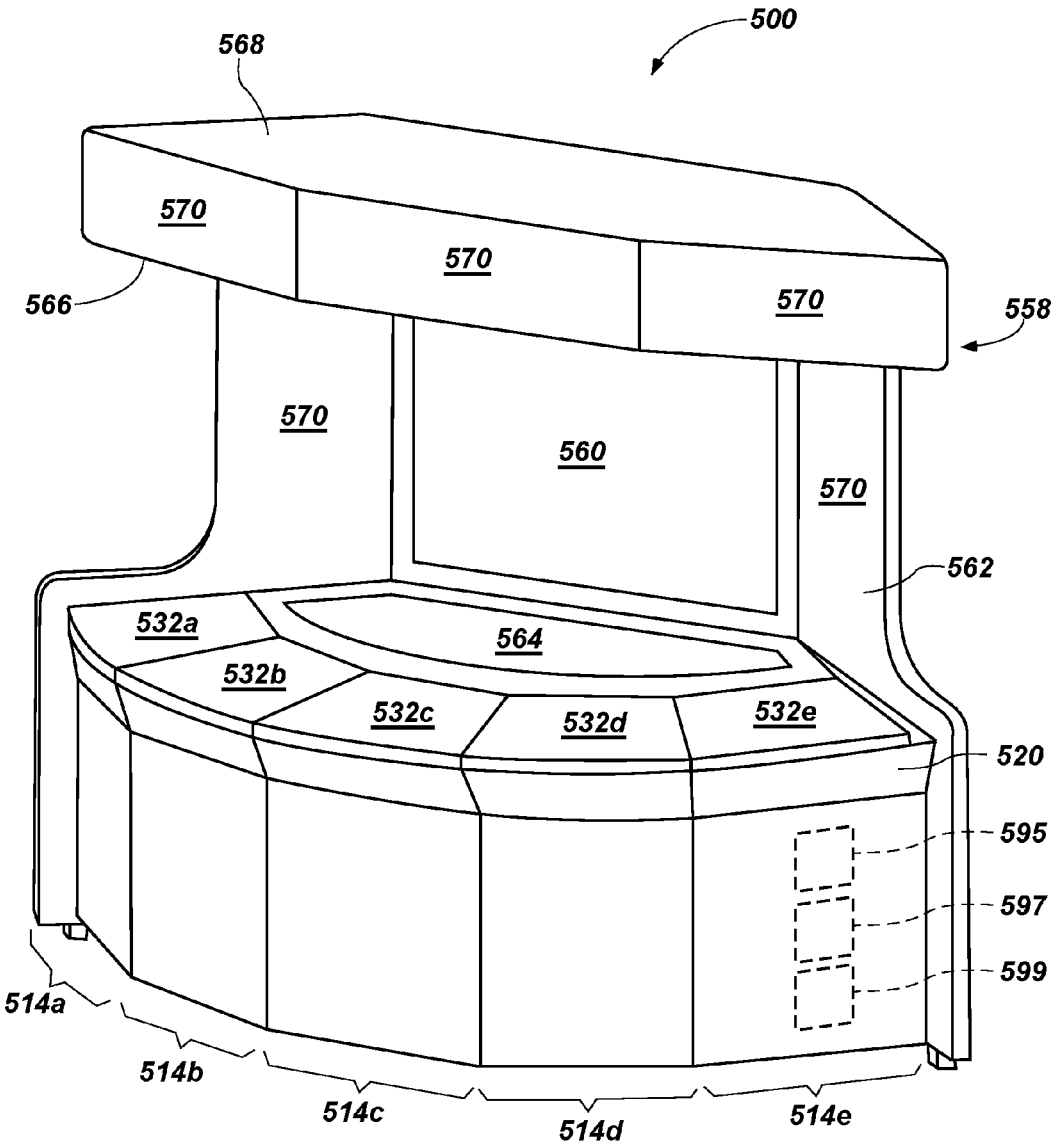
FIG. 6 is a perspective view of another embodiment of a table configured for implementation of embodiments of wagering games in accordance with the present disclosure, wherein the implementation includes a virtual dealer.

Referring to FIG. 6, another example of a suitable multiple-player, electronic table 500 configured for implementation of embodiments of wagering games having a virtual dealer according to the present disclosure is shown. The table 500 may include player positions 514*a* through 514*e* that are arranged in a bank about an arcuate edge 520 of a video device 558 that may comprise a roulette wheel screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The roulette wheel screen 564 may be configured to display at least a virtual roulette wheel operated by the virtual dealer on the dealer screen 560.

Each of the player positions 514*a* through 514*e* may include a player interface area 532*a* through 532*e* that is configured for wagering and game play interactions with the video device 558 and/or virtual dealer. Accordingly, game play may be accommodated without involving a physical roulette wheel, physical chips, and/or live personnel. The action may instead be simulated by a control processor 597 interacting with and controlling the video device 558. The control processor 597 may be located internally within, or otherwise proximate to, the video device 558. The control processor 597 may be programmed, by known techniques, to implement the rules of game play at the video device 558. As such, the control processor 597 may interact and communicate with display/input interfaces and data entry inputs for each player interface area 532*a* through 532*e* of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices (not shown) through a suitable communication media, such, as, for example, wired networks, Wi-Fi networks, and cellular communication networks.

The video device 558 may further include banners (not shown) configured to communicate rules of play and/or the like, which may be located along one or more walls 570 of the cabinet 562. The video device 558 may further include additional decorative lights (not shown) and speakers (not shown), which may be located on an underside surface 566, for example, of a generally horizontally depending top 568 of the cabinet 562 of the video device 558 generally extending toward the player positions 514*a* through 514*e*.

Further detail of an example of a table and player displays is disclosed in U.S. patent application Ser. No. 10/764,995, filed Jan. 26, 2004, published as U.S. Patent Application Publication No. 2005/0164762 on Jul. 28, 2005, now U.S. Pat. No. 8,272,958, issued Sep. 25, 2012, and titled "AUTOMATED MULTIPLAYER GAME TABLE WITH UNIQUE IMAGE FEED OF DEALER," the disclosure of each of which application and patent is incorporated herein in its entirety by this reference. Although an embodiment is described showing individual discrete player stations, in some embodiments, the entire playing surface (e.g., player interface areas 532*a* through 532*e*, roulette wheel screen 564, etc.) may be an electronic display that is logically partitioned to permit game play from a plurality of players for receiving inputs from, and displaying game information to, the players, the dealer, or both.

As a specific, nonlimiting example, a gaming table for administering a game of roulette may include a playing surface including at least one player interface for at least one player position, an operator interface, and at least one processor. The at least one processor may be programmed to: accept a wager from a player; randomly select a multiplier from a group of fixed multipliers for a payout on the wager; randomly generate a number and associated color within a range of numbers and associated colors; resolve the wager by determining whether the randomly generated number is identical to a randomly generated number from an immediately preceding round; authorize payment of a payout to the player when the randomly generated number is identical to the randomly generated number from the immediately preceding round, an amount of the payout being equal to an amount of the wager multiplied by the randomly selected multiplier; and authorize collection of the amount of the wager for the house when the randomly generated number is different from the randomly generated number from the immediately preceding round.

Figure 7:
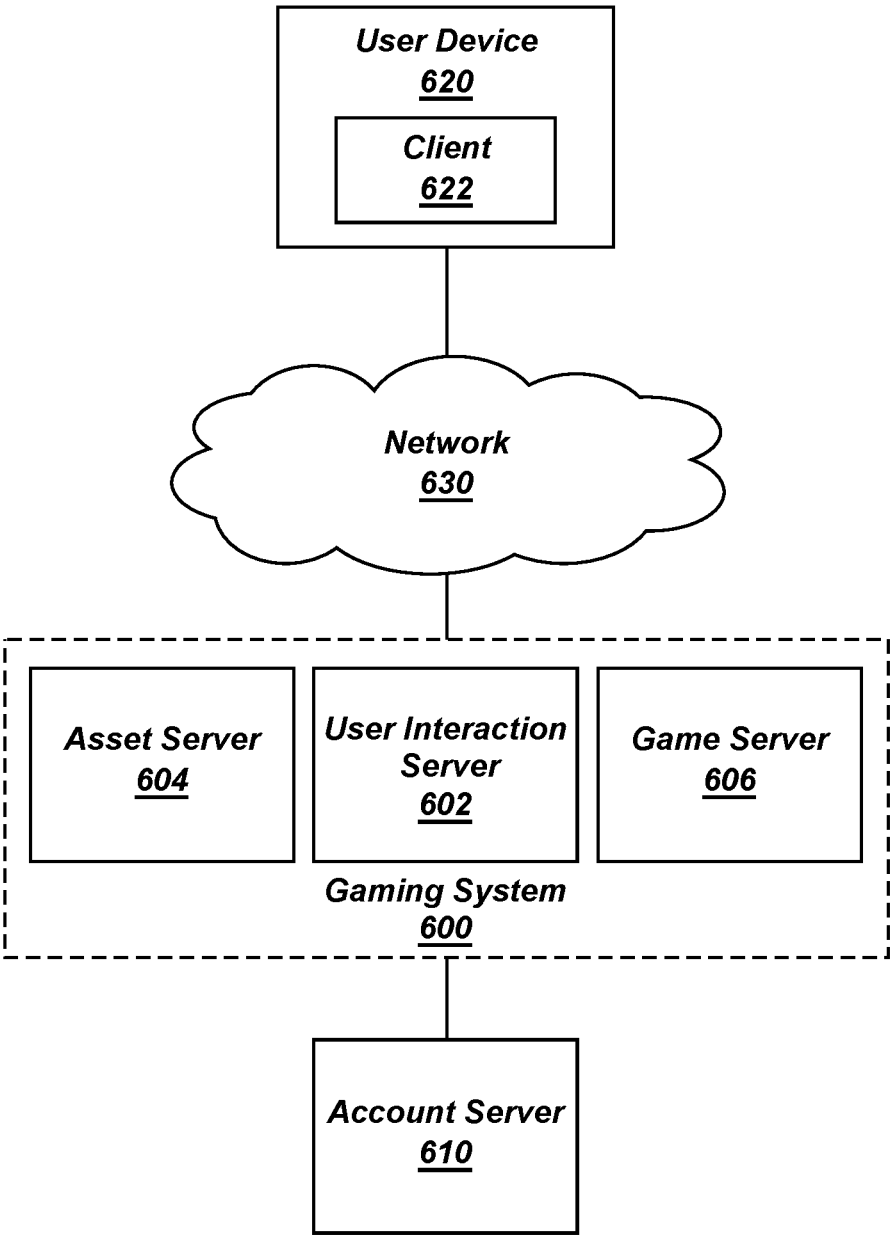
FIG. 7 is a schematic block diagram of a gaming system for implementing embodiments of waging games in accordance with the present disclosure.

Wagering games in accordance with embodiments of the disclosure may be administered over the Internet, or otherwise online, in one embodiment using a gaming system employing a client server architecture. Referring to FIG. 7, illustrated is a schematic block diagram of a gaming system 600 for implementing wagering games according to an embodiment of the present disclosure. The gaming system 600 enables end users to access proprietary and/or non-proprietary game content through an online casino client 622 ("the client 622"). Such game content may include, without limitation, various types of wagering games such as card games, dice games, big wheel games, roulette, scratch off games ("scratchers"), and any other wagering game where the game outcome is determined, in whole or in part, by one or more random events.

The client 622 may be an online casino that handles user funds, and enables play of a wide variety of casino-style games, such as roulette, card games, dice games, slot games, and EGM games. A player accesses the client 622 with a user device 620 such as a personal computer, tablet, cell phone or other mobile device over a network, such as the Internet or a closed casino network. Players are able to make real money wagers through the user device 620 and the client 622 delivers game results to the player over a network (not shown). Losses are taken by the online casino, and wins are paid out to the player. The client 622 handles client funds, and interacts with financial service providers to transfer funds in and out of the casino accounts. The server architecture of the client 622 can take many forms. In one example, the client 622 is operably connected to a separate remote gaming system 600 that administers and delivers game results for one or more games, but in other embodiments, all of the online game play is administered in the client 622. Exemplary gaming systems 600 deliver game results, administer game rules, and confirm wagers are made and that funds are available, but such systems do not interact directly with users and do not handle player funds.

The wagering games supported by the gaming system 600 may track player account balances and may use this information to confirm a game result can be delivered. The same system could be used to administer play-for-fun games in which account balances are tracked but do not represent real currency.

The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform that establishes a portal for an end user to access via a user device 620 to a wagering game hosted by a game server 606 through a user interaction server 602. The user device 620 may communicate with a user interaction server 602 of the gaming system 600 using a network 630 (e.g., the Internet). The user interaction server 602 may communicate with the game server 606 and provide game information, such as graphical displays and game interactions to the user. In some embodiments, the functionality of the gaming system may be incorporated into the online casino client 622. In some embodiments, a single user device 620 communicates with a game provided by the game server 606, while other embodiments may include a plurality of user devices 620 configured to communicate and provide end users with access to the same game provided by the game server 606. In addition, a plurality of end users may be permitted to access a single user interaction server 602, or a plurality of user interaction servers 602, to access the game server 606.

The user interaction server 602 may communicate with the user device 620 through the client 622 to enable access to the gaming system 600. The user may be unaware that the game is being administered by gaming system 600 and not the client 622. In embodiments, the user device 620 includes a user display that includes game assets delivered from the asset server 604 from gaming system 600, as well as casino assets (such as the casino name, logo and other distinctive graphics) delivered by the client 622. The user interaction server 602 may enable a user to create and access a user account and interact with gaming server 606. The user interaction server 602 may enable users to initiate new games, join existing games, and interface with games being played by the user.

In some embodiments, the user interaction server 602 may also provide the client 622 for execution on the user device 620 for accessing the gaming system 600. The client 622 provided by the gaming system 600 for execution on the user device 620 can comprise a variety of implementations according to the user device 620 and method of communication with the gaming system 600. In one embodiment, the user device 620 connects to the gaming system 600 using a web browser, and the client 622 executes within a browser window or frame of the web browser. In another embodiment, the client 622 is a stand-alone executable on the user device 620.

In one embodiment, the client 622 may comprise a relatively small amount of script (e.g., JAVASCRIPT®), also referred to as a "script driver," including scripting language that controls an interface of the client 622. The script driver may include simple function calls requesting information from the gaming system 600. In other words, the script driver stored in the client 622 may merely include calls to functions that are externally defined by, and executed by, the gaming system 600. As a result, the client 622 may be characterized as a "thin client." As that term is used herein, the client 622 may be little more than a script player. The client 622 may simply send requests to the gaming system 600 rather than performing logic itself for the games administered by gaming system 600. The client 622 may perform logic for other games that are not administered by gaming system 600. For example, gaming system 600 may administer an online casino's card games while all other games are administered by the client 622. The client 622 receives player inputs, and the player inputs are passed to the gaming system 600 for processing and executing the wagering game. In one embodiment, this includes providing specific graphical display information to the client 622 as well as game outcomes.

In other embodiments, the client 622 comprises an executable file rather than a script. In that case, the client 622 may do more local processing than does a script driver, such as calculating where to show what game symbols upon receiving a game outcome from game server 606 through user interaction server 602. In one embodiment, it may be that portions of an asset server 604 are loaded onto the client 622 and are used by the client 622 in processing and updating graphical displays. Due to security and integrity concerns, most embodiments will have the bulk of the processing of the game play performed in the gaming system 600. However, some embodiments may include significant game processing by the client 622 when the client and user device 620 are considered trustworthy or when there is reduced concern for security and integrity in the displayed game outcome. In most embodiments, it is expected that some form of data protection, such as end-to-end encryption, will be used when data is transported over network 630. Network 630 may be any network, including, but not limited to, the Internet.

In an embodiment where the client 622 implements further logic and game control methodology beyond the thin client, the client 622 may parse and define player interactions prior to passing the player interactions to the gaming system 600. Likewise, when the client 622 receives a gaming interaction from the gaming system 600, the client 622 may be configured to determine how to modify the display as a result of the gaming interaction. The client 622 may also allow the player to change a perspective or otherwise interact with elements of the display that do not change aspects of the game.

The gaming system 600 may include an asset server 604, which may host various media assets (e.g., audio, video, and image files) that may be sent to the client 622 for presenting the various wagering games to the end user. In other words, in this embodiment, the assets presented to the end user may be stored separately from the client 622. In one embodiment, the client 622 requests the assets appropriate for the game played by the user; in other embodiments, especially those using thin clients, just those assets that are needed for a particular display event will be sent by game server 606 when the game server 606 determines they are needed, including as few as one asset. In one example, the client 622 may call a function defined at the user interaction server 602 or asset server 604, which may determine which assets are to be delivered to the client 622 as well as how the assets are to be presented by the client 622 to the end user. Different assets may correspond to the various clients that may have access to the game server 606 or to different games to be played.

The game server 606 is configured to perform game play methods and determine game play outcomes that are provided to the user interaction server 602 to be transmitted to the user device 620 for display on the end user's computer. For example, the game server 606 may include game rules for one or more wagering games, such that the game server 606 controls some or all of the game flow for a selected wagering game as well as the determined game outcomes. The game server 606 may include pay tables and other game logic. The game server 606 also performs random number generation for determining random game elements of the wagering game. In one embodiment, the game server 606 is separated from the user interaction server 602 by a firewall or other method of preventing unauthorized access to the game server 606 from the general members of the network 630.

The user device 620 may present a gaming interface to the player and communicate the user interaction to the gaming system 600. The user device 620 may be any electronic system capable of displaying gaming information, receiving user input, and communicating the user input to the gaming system 600. As such, the user device 620 can be a desktop computer, a laptop, a tablet computer, a set-top box, a mobile device (including, but not limited to, a smartphone), a kiosk, a terminal, or another computing device. The user device 620 operating the client 622 may comprise an interactive electronic gaming system 300 (see FIG. 4), as described above. The client 622 may be a specialized application or may be executed within a generalized application capable of interpreting instructions from an interactive gaming system, such as a web browser.

The client 622 may interface with an end user through a web page or an application that runs on a device including, but not limited to, a smartphone, a tablet, or a general computer, or the client 622 may be any other computer program configurable to access the gaming system 600. The client 622 may be illustrated within a casino webpage (or other interface) indicating that the client 622 is embedded into a webpage, which is supported by a web browser executing on the user device 620.

In one embodiment, the gaming system 600 may be operated by a different entity than the operator of the client 622. The hardware of gaming system 600 may be located remotely from the client 622. The user device 620 may be operated by a third party, such as a casino or an individual, that links to the gaming system 600, which may be operated, for example, by a wagering game service provider. Therefore, in some embodiments, the user device 620 and the client 622 may be operated by a different administrator than the operator of the game server 606, and the user device 620 and the client 622 may also be operated by separate administrators. In other words, the user device 620 may be part of a third-party system that does not administer or otherwise control the gaming system 600 or game server 606.

In another embodiment, the user interaction server 602 and asset server 604 are provided by a third-party system. For example, a gaming entity (e.g., a casino) may operate the user interaction server 602 or user device 620 to provide its customers access to game content managed by a different entity that may control game server 606, amongst other functionality. In some embodiments, these functions are operated by the same administrator. For example, a gaming entity (e.g., a casino) may elect to perform each of these functions in-house, such as providing both the access to the user device 620 and the actual game content and providing administration of the gaming system 600.

The gaming system 600 may communicate with one or more external account servers 610, optionally through another firewall. For example, the gaming system 600 itself may not directly accept wagers or issue payouts. That is, the gaming system 600 may facilitate online casino gaming but may not be part of a self-contained online casino itself. Instead, the gaming system 600 may facilitate the play of wagering games owned and controlled by a company offering games and gaming products and services, such as Bally Technologies, Inc., formerly SHFL entertainment, Inc. Another entity (e.g., a casino or any account holder or financial system of record) may operate and maintain its external account servers 610 to accept bets and make payout distributions. The gaming system 600 may communicate with the account servers 610 to verify the existence of funds for wagering and to instruct the account server 610 to execute debits and credits.

In some embodiments, the gaming system 600 may directly accept bets and make payout distributions, such as in the case where an administrator of the gaming system 600 operates as the client 622. As discussed above, the gaming system 600 may be integrated within the operations of a casino rather than separating out functionality (e.g., game content, game play, credits, debits, etc.) among different entities. In addition, for play-for-fun wagering games, the gaming system 600 may issue credits, take bets, and manage the balance of the credits according to the game outcomes, but the gaming system 600 may not permit payout distributions or be linked to an account server 610 that permits payout distributions. Such credits may be issued for free, through purchase, or for other reasons, without the ability for the player to cash out. Such play-for-fun wagering games may be administered on platforms that do not permit traditional gambling, such as to comply with jurisdictions that do not permit online gambling. In embodiments where a user device 620 accesses games administered by gaming system 600 through the client 622, the account server 610 contains "mirror accounts" that track account balances to confirm wagers have been made and there are funds to support the wagers before delivering game results. In this embodiment, no actual player funds are handled by the account server 610.

The gaming system 600 may be configured in many ways, from a fully integrated single system to a distributed server architecture. The asset server 604, the user interaction server 602, the game server 606, and the account server 610 may be configured as a single, integrated system of code modules running on a single server or machine, where each of the servers is functionally implemented on a single machine. In such a case, the functionality described herein may not be implemented as separate code modules. The asset server 604, the user interaction server 602, the game server 606, and the account server 610 may also be implemented as a plurality of independent servers, each using its own code modules running on a separate physical machine, and may further include one or more firewalls between selected servers (depending on security needs). Each server could communicate over some kind of networked connection, potentially as varied as that described for network 630. Further, each single server shown in FIG. 7 may be implemented as a plurality of servers with load balancing and scalability factors built into the embodiment. All such embodiments and variations are fully contemplated.

Additional features may be supported by the game server 606, such as hacking and cheating detection, data storage and archival, metrics generation, messages generation, output formatting for different end user devices, as well as other features and operations. For example, the gaming system 600 may include additional features and configurations as described in U.S. patent application Ser. No. 13/353,194, filed Jan. 18, 2012, and application Ser. No. 13/609,031, filed Sep. 10, 2012, both titled "NETWORK GAMING ARCHITECTURE, GAMING SYSTEMS, AND RELATED METHODS," the disclosures of which are incorporated herein in their entirety by this reference.

The network 630 may enable communications between the user device 620 and the gaming system 600, and the user device 620 and the online casino client 622. A network may also connect the gaming system 600 and account server 610, and, further, one or more networks may interconnect one or more of the other servers shown collectively as the game system 600. In one embodiment, the network 630 uses standard communications technologies and/or protocols. Thus, the network 630 can include links using technologies such as Ethernet, 802.11, worldwide interoperability for microwave access (WIMAX®), 3G, digital subscriber line (DSL), asynchronous transfer mode (ATM), INFINIBAND®, PCI Express Advanced Switching, etc. Similarly, the networking protocols used on the network 630 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 630 can be represented using technologies and/or formats including the hypertext markup language (HTML), the extensible markup language (XML), etc. In addition, all or some of the links can be encrypted using conventional encryption technologies such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 630 can include links comprising one or more networks such as the Internet.

Figure 8:
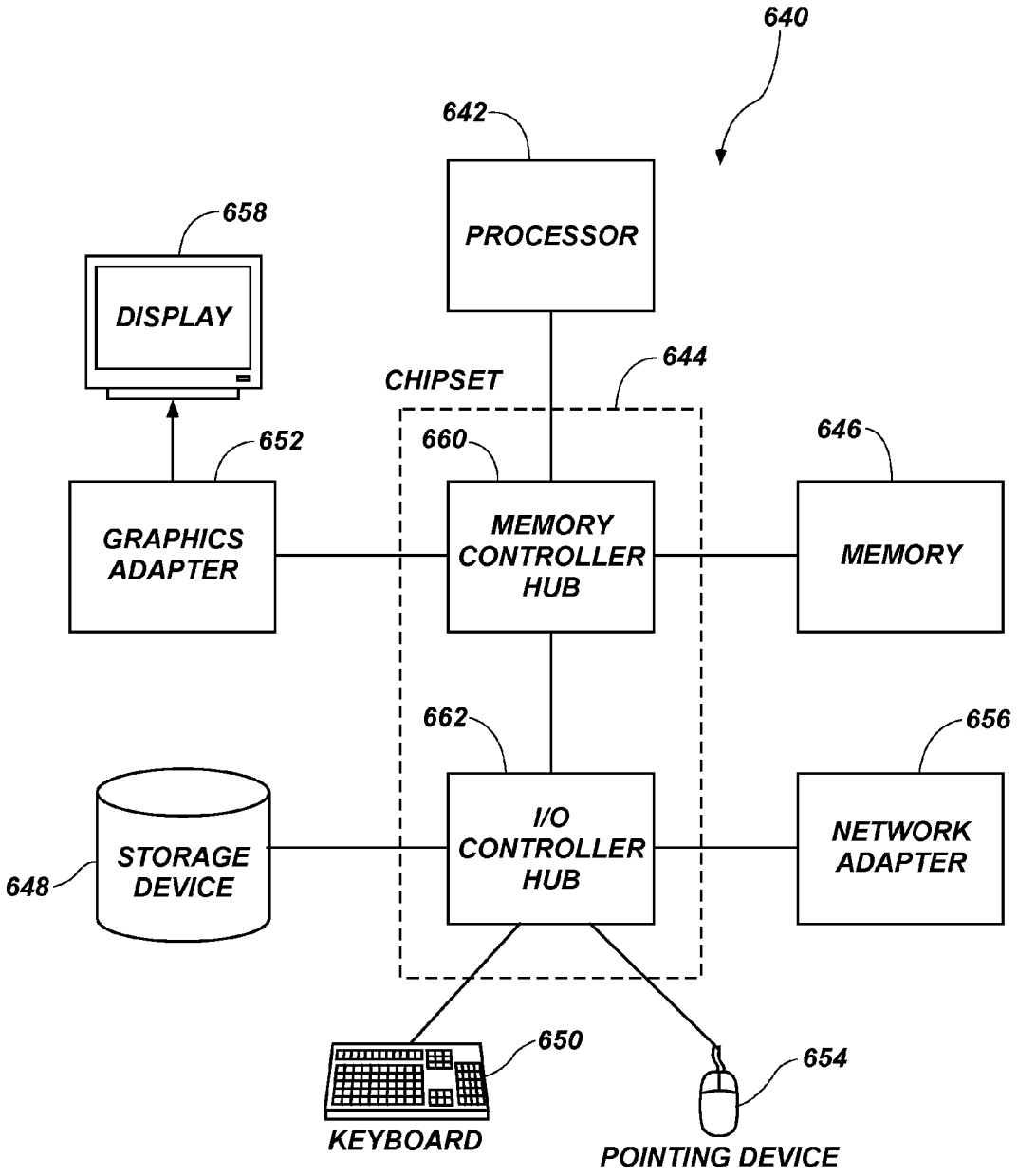
FIG. 8 is a block diagram of a computer for acting as a gaming system for implementing embodiments of wagering games in accordance with the present disclosure.

Referring to FIG. 8, a high-level block diagram of a computer system 640 for acting as the gaming system 600 (see FIG. 7) according to one embodiment is shown. Illustrated are at least one processor 642 coupled to a chipset 644, as indicated in dashed lines. Also coupled to the chipset 644 are memory 646, a storage device 648, a keyboard 650, a graphics adapter 652, a pointing device 654, and a network adapter 656. A display 658 is coupled to the graphics adapter 652. In one embodiment, the functionality of the chipset 644 is provided by a memory controller hub 660 and an I/O controller hub 662. In another embodiment, the memory 646 is coupled directly to the processor 642 instead of to the chipset 644.

The storage device 648 is any non-transitory computer-readable storage medium, such as a hard drive, a compact disc read-only memory (CD-ROM), a DVD, or a solid-state memory device (e.g., a flash drive). The memory 646 holds instructions and data used by the processor 642. The pointing device 654 may be a mouse, a track pad, a track ball, or another type of pointing device, and it is used in combination with the keyboard 650 to input data into the computer system 640. The graphics adapter 652 displays images and other information on the display 658. The network adapter 656 couples the computer system 640 to a local or wide area network.

As is known in the art, the computer system 640 can have different and/or other components than those shown in FIG. 8. In addition, the computer system 640 can lack certain illustrated components. In one embodiment, the computer system 640 acting as the gaming system 600 (FIG. 7) lacks the keyboard 650, pointing device 654, graphics adapter 652, and/or display 658. Moreover, the storage device 648 can be local and/or remote from the computer system 640 (such as embodied within a storage area network (SAN)). Moreover, other input devices, such as, for example, touch screens may be included.

The network adapter 656 (may also be referred to herein as a communication device) may include one or more devices for communicating using one or more of the communication media and protocols discussed above with respect to FIG. 7.

In addition, some or all of the components of this general computer system 640 of FIG. 8 may be used as part of the processor and memory discussed above with respect to the systems of FIGS. 4, 5A, 5B, and 6.

The gaming system 600 (FIG. 7) may comprise several such computer systems 640. The gaming system 600 may include load balancers, firewalls, and various other components for assisting the gaming system 600 to provide services to a variety of user devices.

As is known in the art, the computer system 640 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 648, loaded into the memory 646, and executed by the processor 642.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," or the like, refer to the action and processes of a computer system, or similar electronic computing device (such as a specific computing machine), that manipulates and transforms data represented as physical (electronic) quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product that can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

In some embodiments, wagering games may be administered over a network. For example, a method of administering a game of roulette over a network may involve receiving at a user interaction server authorization from a player to allocate funds to a wager. A multiplier may be randomly selected at a game server from a group of fixed multipliers for a payout on the wager. The game server may randomly generate a number and associated color within a range of numbers and associated colors. The wager may be resolved by determining at the game server whether the randomly generated number is identical to a randomly generated number from an immediately preceding round. The game server may authorize payment of a payout to the player when the randomly generated number is identical to the randomly generated number from the immediately preceding round. An amount of the payout may be equal to an amount of the wager multiplied by the randomly selected multiplier. The game server may authorize collection of the amount of the wager for the house when the randomly generated number is different from the randomly generated number from the immediately preceding round.

As another specific, nonlimiting example, a method of administering a play-for-free game of roulette over a network may include sending from a user interaction server or the client 622 a quantity of valueless wagering elements usable within a predetermined time period to a player. Authorization from a player may be received at the user interaction server or the client 622 to allocate at least one valueless wagering element to a wager. When a gaming system 600 is utilized by the client 622, a game server may randomly select a multiplier from a group of fixed multipliers for a payout on the wager. The game server may randomly generate a number and associated color within a range of numbers and associated colors. The wager may be resolved by determining at the game server whether the randomly generated number is identical to a randomly generated number from an immediately preceding round. The game server may authorize issuance of additional valueless wagering elements to the player when the randomly generated number is identical to the randomly generated number from the immediately preceding round. A quantity of the additional valueless wagering elements may be equal to the quantity of valueless wagering elements allocated to the wager multiplied by the randomly selected multiplier. The game server may authorize deduction of the quantity of valueless wagering elements allocated to the wager when the randomly generated number is different from the randomly generated number from the immediately preceding round. Functions performed by the game server 606 may be performed by other components of the online gaming system 600 or the client 622 in other embodiments.

Games disclosed herein may be implemented as scratch games, such as lottery-type games implemented on physical scratch cards. In other examples of the invention, scratch games may be administered as online games from a gaming system 600 or the client 622.

EXAMPLE

Figure 9:
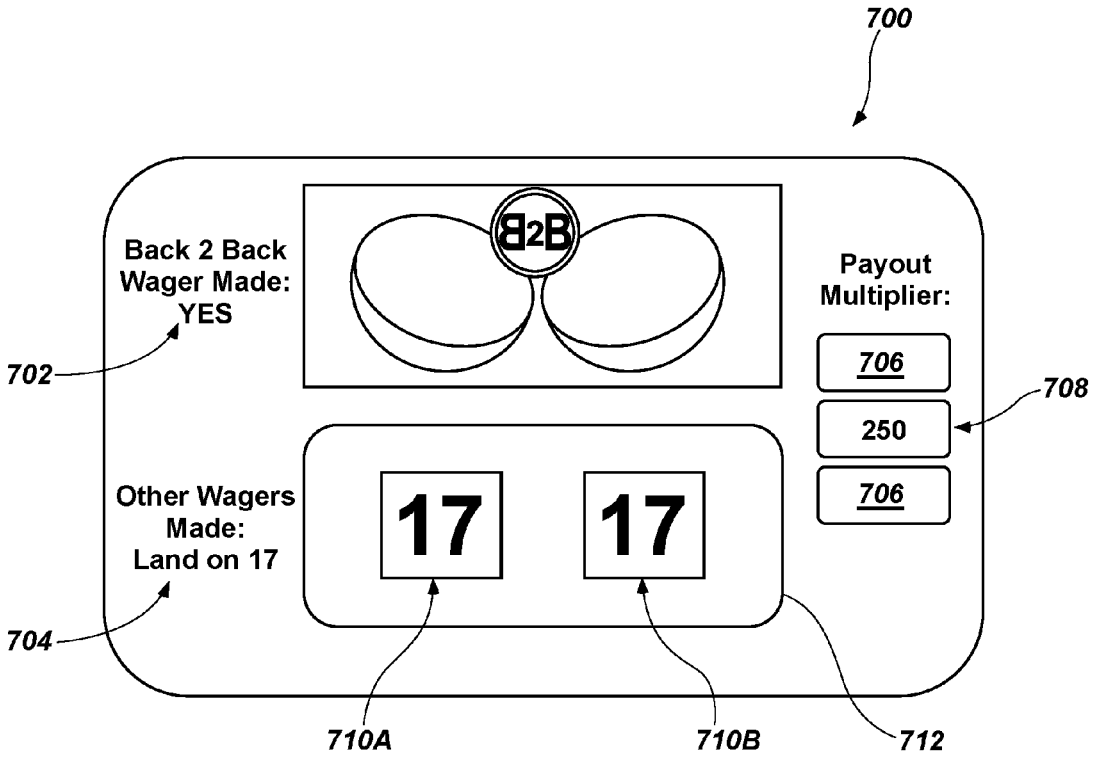
FIG. 9 is a schematic of a scratch card implementation of a wagering game in accordance with the present disclosure.

With reference to FIG. 9, a schematic of a wagering game implemented as a scratch card 700 is shown. The scratch card 700 may include an indication 702, such as, for example, printed text, that a first wager has been accepted from a player in exchange for the scratch card 700. The first wager may be, for example, the wager described previously in connection with actions 102, 108, and 110 of FIG. 1. The scratch card 700 may further include another indication 704, such as, for example, printed text, that another wager has been accepted from the player. The other wager may be, for example, any of the wagers described previously in connection with area 132 of FIG. 2. A group of fixed multipliers may initially be concealed under scratch-off areas 706, one of which may be scratched off by a player to reveal a multiplier 708 to be used for a payoff on the first wager. The multiplier may be randomly selected by the administrator by virtue of the player's blind decision to scratch off one of the areas 706 and the issuer's subsequent acceptance of the scratch card's redemption. Roulette outcome numbers and their associated colors 710A and 710B for two rounds of roulette, 710A being an immediately preceding round and 710B being a current round, may be selected at random when the card is being made, and may initially be concealed under a scratch-off material within an outcome area 712. The first wager and the other wager may be resolved by accepting a player's redemption of the scratch card 700 with one of the fixed multiplier scratch-off areas 706 being removed to reveal a multiplier 708 and with the outcome numbers and their associated colors 710 being revealed within the outcome area 712. When the randomly generated outcome numbers 710 are identical to one another, a payout on the first wager may be paid to the player. The payout may be equal to an amount of the first wager multiplied by the multiplier 708. When the randomly generated outcome numbers 710 are different from one another, the amount of the first wager may be collected by the issuer of the scratch card 700 or another administrator of the wagering game. The other wager may be resolved by comparing a predicted characteristic of the outcome at 704 to the actual outcome at 710B, and paying a payout when they are the same and collecting an amount of the other wager when they are different.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventors.

What is claimed is:

1. A method of administering a game of roulette, comprising:

accepting a first wager on a base game roulette outcome from a player;

accepting a second wager on a bonus roulette outcome from the player;

randomly generating a number and associated color within a range of numbers and associated colors utilizing a physical, spinning roulette wheel;

resolving the second wager by comparing the randomly generated number and associated color to a randomly generated number and associated color from an immediately preceding round to determine whether the randomly generated number and associated color from the current round is identical to the randomly generated number and associated color from the immediately preceding round;

using a random multiplier selection apparatus operatively associated with the roulette table to randomly select a multiplier from a group of fixed multipliers for a payout on the second wager when the randomly generated number and associated color from the current round is identical to the randomly generated number and associated color from the immediately preceding round;

paying a bonus payout on the second wager to the player when the randomly generated number and associated color is identical to the randomly generated number and associated color from the immediately preceding round, an amount of the payout being equal to an amount of the wager multiplied by the randomly selected multiplier for the current round;

collecting the amount of the second wager for the house when the randomly generated number is different from the randomly generated number from the immediately preceding round; and resolving the first wager.

2. The method of claim 1, wherein using the random multiplier selection apparatus to randomly select the multiplier from the group of fixed multipliers comprises using the random multiplier selection apparatus to randomly select the multiplier from the group of fixed multipliers consisting of 10 times, 25 times, 50 times, 100 times, 250 times, 500 times, and 1,000 times.

3. The method of claim 2, wherein using the random multiplier selection apparatus to randomly select the multiplier from the group of fixed multipliers comprises using the random multiplier selection apparatus to randomly select the multiplier from the group of weighted fixed multipliers, wherein lower multipliers are more likely to be selected than higher multipliers.

4. The method of claim 3, wherein using the random multiplier selection apparatus to randomly select the multiplier from the group of weighted fixed multipliers comprises weighting the weighted fixed multipliers such that 10 times is selected with a theoretical average frequency of 32.05%, 25 times is selected with a theoretical average frequency of 40%, 50 times is selected with a theoretical average frequency of 19%, 100 times is selected with a theoretical average frequency of 8%, 250 times is selected with a theoretical average frequency of 0.75%, 500 times is selected with a theoretical average frequency of 0.15%, and 1,000 times is selected with a theoretical average frequency of 0.05%.

5. The method of claim 3, wherein using the random multiplier selection apparatus to randomly select the multiplier from the group of weighted fixed multipliers comprises weighting the weighted fixed multipliers such that 10 times is selected with a theoretical average frequency of 32.55%, 25 times is selected with a theoretical average frequency of 40%, 50 times is selected with a theoretical average frequency of 20%, 100 times is selected with a theoretical average frequency of 6.5%, 250 times is selected with a theoretical average frequency of 0.75%, 500 times is selected with a theoretical average frequency of 0.15%, and 1,000 times is selected with a theoretical average frequency of 0.05%.

6. The method of claim 1, wherein using the random multiplier selection apparatus to randomly select the multiplier comprises activating a random number generator and using a result of the random number generator to select the multiplier.

7. The method of claim 1, wherein using the random multiplier selection apparatus to randomly select the multiplier comprises rolling a die, each side of the die displaying a multiplier, spinning a wheel including sections, each section displaying a multiplier, or spinning a needle within a wheel including sections, each section displaying a multiplier.

8. The method of claim 1, further comprising displaying the randomly generated number and associated color from the current round, the randomly generated number and associated color from the immediately preceding round, and the randomly selected multiplier when applicable on an electronic display device operatively connected to the electronic random number generator, the random multiplier selection apparatus, and the nontransitory memory.

9. The method of claim 8, wherein displaying the randomly generated number and associated color from the current round on the electronic display device comprises displaying an animation of a virtual roulette wheel.

10. The method of claim 8, further comprising displaying additional, historical randomly generated numbers and associated colors from at least some rounds occurring before the immediately preceding round on the electronic display device.

11. The method of claim 1, wherein randomly generating the number and associated color within the range of numbers and associated colors comprises randomly generating the number from the group consisting of 00 and 0 through 36, each of which is assigned an associated color from the group consisting of red, black, and green.

12. The method of claim 1, wherein the second wager is optional.

13. A method of administering a game of roulette, comprising:

accepting a base game wager on a base game roulette outcome from a player;

accepting a bonus wager on a bonus roulette outcome from the player;

randomly generating a number and associated color within a range of numbers and associated colors utilizing a physical, spinning roulette wheel in response to an input received at an operator interface device operatively associated with a roulette table;

resolving the bonus wager utilizing a processor operatively associated with the roulette table by comparing the randomly generated number to a randomly generated number from an immediately preceding round stored in nontransitory memory operatively connected to the processor to determine whether the randomly generated number and associated color from the current round is identical to the randomly generated number and associated color from the immediately preceding round;

using a random multiplier selection apparatus operatively associated with the roulette table to randomly select a multiplier from a group of fixed multipliers consisting of 0 times, 100 times, 250 times, 500 times, and 1,000 times for a payout on the bonus wager when the randomly generated number and associated color from the current round is identical to the randomly generated number and associated color from the immediately preceding round;

displaying the randomly generated number and associated color from the current round, the randomly generated number and associated color from the immediately preceding round, and the randomly selected multiplier when applicable on an electronic display device operatively connected to the random multiplier selection apparatus and the nontransitory memory;

displaying an amount of a payout for the bonus wager on the electronic display device and paying the payout to the player when the randomly generated number is identical to the randomly generated number from the immediately preceding round, the amount of the payout being equal to an amount of the bonus wager multiplied by the randomly selected multiplier;

collecting the amount of the bonus wager for the house when the randomly generated number is different from the randomly generated number from the immediately preceding round; and resolving the base game wager by comparing a characteristic of the randomly generated number and associated color with a characteristic associated with the first wager.

14. The method of claim 13, wherein using the random multiplier selection apparatus to randomly select the multiplier from the group of fixed multipliers comprises randomly selecting the multiplier from a group of weighted fixed multipliers, wherein lower multipliers are more likely to be selected than higher multipliers.

15. The method of claim 14, wherein using the random multiplier selection apparatus to randomly select the multiplier from the group of weighted fixed multipliers comprises weighting the weighted fixed multipliers such that 10 times is selected with a theoretical average frequency of 32.05%, 25 times is selected with a theoretical average frequency of 40%, 50 times is selected with a theoretical average frequency of 19%, 100 times is selected with a theoretical average frequency of 8%, 250 times is selected with a theoretical average frequency of 0.75%, 500 times is selected with a theoretical average frequency of 0.15%, and 1,000 times is selected with a theoretical average frequency of 0.05%.

16. The method of claim 14, wherein using the random multiplier selection apparatus to randomly select the multiplier from the group of weighted fixed multipliers comprises weighting the weighted fixed multipliers such that 10 times is selected with a theoretical average frequency of 32.55%, 25 times is selected with a theoretical average frequency of 40%, 50 times is selected with a theoretical average frequency of 20%, 100 times is selected with a theoretical average frequency of 6.5%, 250 times is selected with a theoretical average frequency of 0.75%, 500 times is selected with a theoretical average frequency of 0.15%, and 1,000 times is selected with a theoretical average frequency of 0.05%.

17. The method of claim 13, wherein using the random multiplier selection apparatus to randomly select the multiplier comprises activating a random number generator and using a result of the random number generator to select the multiplier.

18. The method of claim 13, wherein displaying the randomly generated number and associated color from the current round on the electronic display device comprises displaying an animation of a virtual roulette wheel.

19. The method of claim 13, further comprising displaying additional, historical randomly generated numbers and associated colors from at least some rounds occurring before the immediately preceding round on the electronic display device.

20. The method of claim 13, wherein randomly generating the number and associated color within the range of numbers and associated colors comprises randomly generating the number from the group consisting of 00 and 0 through 36, each of which is assigned an associated color from the group consisting of red, black, and green.

* * * * *